US006705611B2

(12) United States Patent
Kato

(10) Patent No.: US 6,705,611 B2
(45) Date of Patent: Mar. 16, 2004

(54) GAME MACHINE, AND DISPLAY

(75) Inventor: Yoshihito Kato, Tokyo (JP)

(73) Assignee: Konami Corporation, Tokyo (JP)

( * ) Notice: Subject to any disclaimer, the term of this patent is extended or adjusted under 35 U.S.C. 154(b) by 0 days.

(21) Appl. No.: 10/247,622

(22) Filed: Sep. 20, 2002

(65) Prior Publication Data

US 2003/0062682 A1 Apr. 3, 2003

(30) Foreign Application Priority Data

Sep. 21, 2001 (JP) ..... P2001-288537

(51) Int. Cl.[7] ..... G07F 17/34

(52) U.S. Cl. ..... 273/143 R; 273/138.2; 463/20

(58) Field of Search ..... 463/20, 16; 273/143 R, 273/138.2, 138.1

(56) References Cited

FOREIGN PATENT DOCUMENTS

GB 2160345 * 12/1985 ..... 273/143 R
GB 2193025 * 1/1988 ..... 273/143 R
GB 2248712 * 4/1992 ..... 273/143 R

* cited by examiner

*Primary Examiner*—Benjamin H. Layno
(74) *Attorney, Agent, or Firm*—Sughrue Mion, PLLC

(57) ABSTRACT

Protrusions, serving as reference marks for indicating reference positions at which reel strips (106) are to be applied, are provided on three unillustrated reel frameworks. Marks for registration purpose to be aligned with the respective protrusions are provided individually on the respective three reel tapes. At least two reel strips differ in relative position, with respect to a spinning direction of the reels, between the mark and symbols on the reel strips. When the reel frameworks are stopped at rotation detection positions defined by unillustrated sensors, positions of respective symbols on rotation paths defined between the reel frameworks corresponding to at least two reel strips are shifted from each other in the spinning direction of the reels.

7 Claims, 18 Drawing Sheets

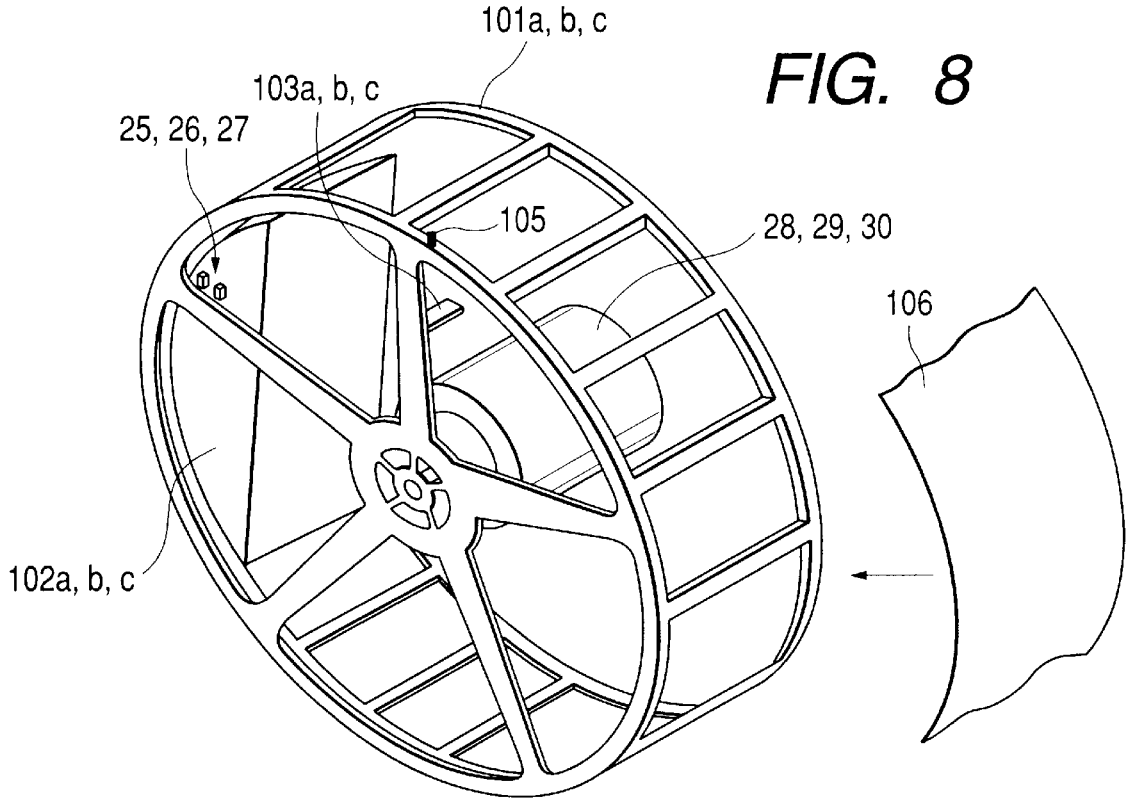
FIG. 8
FIG. 9
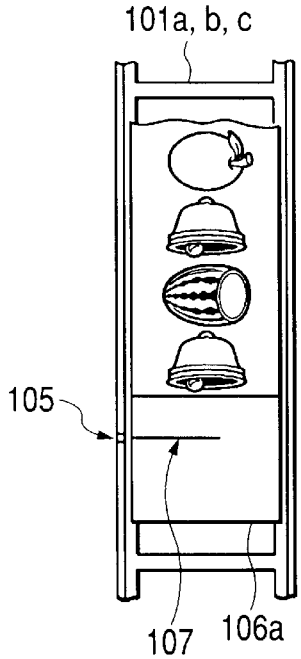
FIG. 10
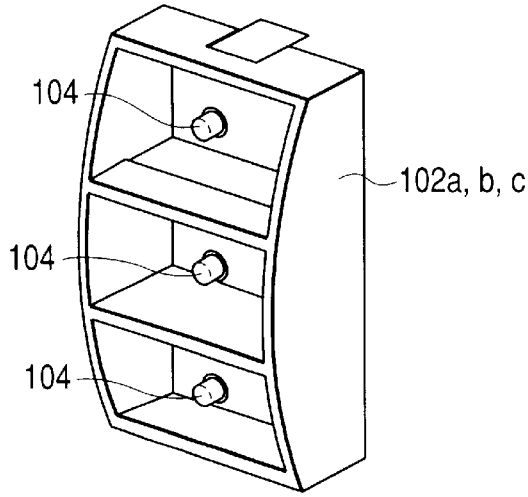

FIG. 14

| POSITION NO. | SYMBOL ON CENTER REEL (msec) | LOWER LINE MOVEMENT TIMING (msec) | STOP OPERATION (msec) | REEL STOP TIMING (msec) | LAPSE OF TIME SINCE PREVIOUS TIMING (msec) |
|---|---|---|---|---|---|
| 2 | BELL | 726.18 | UP TO NEXT 80 | NEXT 83.328 | (11.9) |
| 3 | PLUM | 690.466 | | | |
| 4 | CHERRY | 654.752 | UP TO 650 | 654.752 | 11.9 |
| 5 | BAR | 619.038 | | | |
| 6 | BELL | 583.324 | | | |
| 7 | PLUM | 547.61 | | | |
| 8 | CHERRY | 511.896 | | | |
| 9 | BLUE 7 | 476.182 | UP TO 470 | 476.182 | 11.9 |
| 10 | BELL | 440.468 | | | |
| 11 | CHERRY | 404.754 | | | |
| 12 | WATERMELON | 369.04 | | | |
| 13 | BAR | 333.326 | UP TO 330 | 333.326 | 11.9 |
| 14 | BELL | 297.612 | | | |
| 15 | PLUM | 261.898 | | | |
| 16 | CHERRY | 226.184 | UP TO 220 | 226.184 | 11.9 |
| 17 | BLUE 7 | 190.47 | | | |
| 18 | BELL | 154.756 | | | |
| 19 | PLUM | 119.042 | | | |
| 20 | CHERRY | 83.328 | UP TO 80 | 83.328 | 11.9 |
| 21 | WATERMELON | 47.614 | | | |
| 1 | RED 7 | 11.9(761.9) | | | |

REEL SPIN TIME = 750 MSEC/SPIN

FIG. 15

| POSITION NO. | SYMBOL ON RIGHT REEL (msec) | LOWER LINE MOVEMENT TIMING (msec) | STOP OPERATION (msec) | REEL STOP TIMING (msec) | LAPSE OF TIME SINCE PREVIOUS TIMING (msec) |
|---|---|---|---|---|---|
| 2 | BELL | 738.08 | UP TO NEXT 90 | NEXT 95.228 | (23.8) |
| 3 | PLUM | 702.366 | | | |
| 4 | CHERRY | 666.652 | UP TO 660 | 666.652 | 23.8 |
| 5 | BAR | 630.938 | | | |
| 6 | BELL | 595.224 | | | |
| 7 | PLUM | 559.51 | | | |
| 8 | CHERRY | 523.796 | | | |
| 9 | BLUE 7 | 488.082 | UP TO 480 | 488.082 | 23.8 |
| 10 | BELL | 452.368 | | | |
| 11 | CHERRY | 416.654 | | | |
| 12 | WATERMELON | 380.94 | | | |
| 13 | BAR | 345.226 | UP TO 340 | 345.226 | 23.8 |
| 14 | BELL | 309.512 | | | |
| 15 | PLUM | 273.798 | | | |
| 16 | CHERRY | 238.084 | UP TO 230 | 238.084 | 23.8 |
| 17 | BLUE 7 | 202.37 | | | |
| 18 | BELL | 166.656 | | | |
| 19 | PLUM | 130.942 | | | |
| 20 | CHERRY | 95.228 | UP TO 90 | 95.228 | 23.8 |
| 21 | WATERMELON | 59.514 | | | |
| 1 | RED 7 | 23.8(773.8) | | | |

REEL SPIN TIME = 750 MSEC/SPIN

FIG. 22

| POSITION NO. | SYMBOL ON LEFT REEL (msec) | LOWER LINE MOVEMENT TIMING (msec) | STOP OPERATION (msec) | REEL STOP TIMING (msec) |
|---|---|---|---|---|
| 2 | CHERRY | 714.28 | UP TO NEXT 70 | NEXT 71.428 |
| 3 | BAR | 678.566 | | |
| 4 | PLUM | 642.852 | UP TO 640 | 642.852 |
| 5 | BELL | 607.138 | | |
| 6 | WATERMELON | 571.424 | | |
| 7 | RED 7 | 535.71 | | |
| 8 | WATERMELON | 499.996 | | |
| 9 | PLUM | 464.282 | UP TO 460 | 464.282 |
| 10 | BELL | 428.568 | | |
| 11 | CHERRY | 392.854 | | |
| 12 | BLUE 7 | 357.14 | | |
| 13 | PLUM | 321.426 | UP TO 320 | 321.426 |
| 14 | BELL | 285.712 | | |
| 15 | WATERMELON | 249.998 | | |
| 16 | BAR | 214.284 | UP TO 210 | 214.284 |
| 17 | CHERRY | 178.57 | | |
| 18 | BELL | 142.856 | | |
| 19 | WATERMELON | 107.142 | | |
| 20 | PLUM | 71.428 | UP TO 70 | 71.428 |
| 21 | BELL | 35.714 | | |
| 1 | RED 7 | 0(750) | | |

REEL SPIN TIME = 750 MSEC/SPIN

FIG. 23

| POSITION NO. | SYMBOL ON CENTER REEL (msec) | LOWER LINE MOVEMENT TIMING (msec) | STOP OPERATION (msec) | REEL STOP TIMING (msec) |
|---|---|---|---|---|
| 2 | BELL | 714.28 | UP TO NEXT 70 | NEXT 71.428 |
| 3 | PLUM | 678.566 | | |
| 4 | CHERRY | 642.852 | UP TO 640 | 642.852 |
| 5 | BAR | 607.138 | | |
| 6 | BELL | 571.424 | | |
| 7 | PLUM | 535.71 | | |
| 8 | CHERRY | 499.996 | | |
| 9 | BLUE 7 | 464.282 | UP TO 460 | 464.282 |
| 10 | BELL | 428.568 | | |
| 11 | CHERRY | 392.854 | | |
| 12 | WATERMELON | 357.14 | | |
| 13 | BAR | 321.426 | UP TO 320 | 321.426 |
| 14 | BELL | 285.712 | | |
| 15 | PLUM | 249.998 | | |
| 16 | CHERRY | 214.284 | UP TO 210 | 214.284 |
| 17 | BLUE 7 | 178.57 | | |
| 18 | BELL | 142.856 | | |
| 19 | PLUM | 107.142 | | |
| 20 | CHERRY | 71.428 | UP TO 70 | 71.428 |
| 21 | WATERMELON | 35.714 | | |
| 1 | RED 7 | 0(750) | | |

REEL SPIN TIME = 750 MSEC/SPIN

FIG. 24

| POSITION NO. | SYMBOL ON RIGHT REEL (msec) | LOWER LINE MOVEMENT TIMING (msec) | STOP OPERATION (msec) | REEL STOP TIMING (msec) |
|---|---|---|---|---|
| 2 | PLUM | 714.28 | UP TO NEXT 70 | NEXT 71.428 |
| 3 | WATERMELON | 678.566 | | |
| 4 | BELL | 642.852 | UP TO 640 | 642.852 |
| 5 | CHERRY | 607.138 | | |
| 6 | PLUM | 571.424 | | |
| 7 | BLUE 7 | 535.71 | | |
| 8 | BELL | 499.996 | | |
| 9 | CHERRY | 464.282 | UP TO 460 | 464.282 |
| 10 | PLUM | 428.568 | | |
| 11 | WATERMELON | 392.854 | | |
| 12 | BELL | 357.14 | | |
| 13 | CHERRY | 321.426 | UP TO 320 | 321.426 |
| 14 | RED 7 | 285.712 | | |
| 15 | PLUM | 249.998 | | |
| 16 | WATERMELON | 214.284 | UP TO 210 | 214.284 |
| 17 | BELL | 178.57 | | |
| 18 | BAR | 142.856 | | |
| 19 | PLUM | 107.142 | | |
| 20 | WATERMELON | 71.428 | UP TO 70 | 71.428 |
| 21 | BELL | 35.714 | | |
| 1 | RED 7 | 0(750) | | |

REEL SPIN TIME = 750 MSEC/SPIN

GAME MACHINE, AND DISPLAY

BACKGROUND OF THE INVENTION

The invention relates to a game machine having a main display unit in which a plurality of rotary devices are disposed side by side, the devices spinning rotary members, on whose circumferential surfaces reel strips are retained, as well as to a display device.

Slot machines and pachinko machines have hitherto been known as this type of game machine. In each of the game machines, a plurality of reels are disposed side by side, the reels being rotary devices for successively displaying, in a predetermined sequence, a plurality of symbols, such as "PLUM," "BELL," "WATERMELON," "CHERRY," "7," and "BAR." Each reel retains, on a circumferential surface of a reel framework, a reel tape, which is a reel strip having a plurality of symbols printed thereon. The symbols are successively displayed by means of spinning the reel frameworks serving as rotary members. In a display area which is provided in a game machine main unit and enables display of about three to four symbols on each of the reels, symbols printed on the respective reels appear and then disappear from the upstream side to the downstream side in the spinning direction of the reel.

A reel unit, which serves as a main display unit and in which a plurality of reels are provided side by side, is provided with winning lines such that the lines extend across the reels. To the extent possible, the spinning reels are brought to a standstill at a timing of establishment of a combination of symbols corresponding to a result of sampling operation performed by sampling unit, which selects a winning mode such as a "big win" through sampling. When a predetermined combination of symbols is established along a winning line, a predetermined award, such as provision of a bonus game very advantageous to acquisition of a win, is afforded to a player.

The inventor has built a prototype game machine of such a configuration and carried out a test run, which resulted in an anomaly. Specifically, in spite of failure to establish a "winning combination" along a winning line, a win arose. A survey on a cause of the anomaly shows that the anomaly is attributable to erroneous labeling of the reel tapes.

As shown in FIG. 20, a reel 100 employed in a game machine has a reel framework 101 serving as a rotary member, a reel drive motor 28, a backlight device 102, and a reel tape 106. Formed in the reel framework 101 are five spoke sections and a circular ladder section. The five spoke sections extend radially from a shaft section which is connected to the reel drive motor 28. A sensing plate 103 is provided on one of the five spoke sections so as to project toward the inside of the framework. The reel tape 106, on which a plurality of symbols (not shown) are printed, is wrapped around the circular ladder section of the reel framework 101. The backlight device 102 is stationarily provided so as not to move together with the reel framework 101. The backlight device 102 is for illuminating, from the inside, respective symbols provided on the reel tape 106 wrapped around the reel framework 101. A reel position sensor 25 for detecting the sensing plate 103 provided on the reel framework 101 is provided on the side surface of the backlight device 102. When the reel framework 101 spins through a predetermined rotational angle, the reel position sensor 25 detects the sensing plate 103. On the basis of a result of sensing operation performed by the reel position sensor 25, the reel drive motor 28 in operation is stopped, thereby aligning symbols corresponding to a result of sampling along an unillustrated winning line. In the prototype machine, the reels are arranged side by side so as to assume a left position, a center position, and a right position, thereby constituting a single reel unit.

As shown in FIG. 21, the reel tape 106 is formed by printing a plurality of symbols on a plastic film. An overlap margin 106*a* is provided at the lower end of the reel tape 106, and the leading end of the reel tape is superimposed on the overlap margin 106*a*, whereby the reel tape 106 is wrapped around the reel framework 101. A reference mark 107 is printed on the overlap margin 106*a* and represents a reference position for wrapping the reel tape 106 around the reel framework 101 shown in FIG. 20. A small protrusion 105 is provided on the circular ladder portion of the reel framework 101 in the manner as shown in FIG. 20. The reel tape 106 is wrapped such that the protrusion 105 is aligned with the reference mark 107, whereby the reel tape 106 is fixed at a regular position of the reel framework 101.

The reel tape 106 fixed at the regular position places a symbol printed at, e.g., the extremity (i.e., the top shown in FIG. 21) of the reel tape, on an unillustrated winning line at the moment the reel position sensor 25 has detected the sensing plate 103. Seven types of symbols; "RED 7," "BLUE 7," "BAR," "WATERMELON," "BELL," "CHERRY," and "PLUM"; that is, a total number of 21 symbols, are printed on the reel tape 106 shown in FIG. 21. This reel tape 106 is dedicated to the left reel. Custom-designed reel tapes 106, each having seven types of symbols; that is, 21 symbols, printed thereon, are used for the remaining center and right reels. These reel tapes totally differ from the reel tape for the left reel in terms of arrangement of symbols.

As mentioned above, at the moment the reel position sensor 25 has detected the sensing plate 103, the symbol printed at, e.g., the extremity of the reel tape 106 is situated at a winning line. The symbols on the reel tape 106 are printed at given pitches. Each time a period of X msec lapses from that moment, subsequent symbols sequentially come to the winning line. In each of the reel tape 106 for the left reel, that for the center reel, and that for the right reel, "BELL" is assumed to be printed at the third, seventh, and twelfth frames from the extremity position. If the reels are sequentially stopped after lapse of 3×, 7× and 12× msec from the moment, a "BELL winning combination" consisting of three "BELL" symbols can be established along a winning line. Here, the reel tape 106 for the left reel is assumed to have been erroneously labeled to the center reel. If "PLUM" is located at the seventh frame from the extremity position of this reel tape 106, a "failure symbol combination"; that is, "BELL-PLUM-BELL," is displayed along a winning line. Nevertheless, the game machine deems a "BELL winning combination" as having been established along a winning line, thereby effecting a rewarding operation; e.g., payment of a predetermined number of medals. In this way, the foregoing anomaly arises.

In this way, labeling of a reel tape 106 on a reel of inappropriate type results in occurrence of an anomaly. Even when the reel tape 106 is labeled on an appropriate reel, if a reel is placed at an incorrect position; such as the left reel being placed at the position for the right reel, an analogous anomaly arises. Explanation has been given of an example of a slot machine serving as a game machine. However, analogous anomalies arise in a display device which does not have any function of offering games and has only the function of displaying a combination of symbols through use of a main display unit, such as a reel unit.

SUMMARY OF THE INVENTION

The invention has been conceived in light of the foregoing background and aims at providing a game machine and a display device which inhibit occurrence of at least either shipment of a game machine while symbols of inappropriate types are fixed on rotary members or shipment of a game machine while rotary members are mounted at erroneous positions.

In order to solve the aforesaid object, the invention is characterized by having the following arrangement.

(1) A game machine comprising:

a main display in which a plurality of reels, rotatable in a spinning direction, are disposed side by side, each of the plurality of reels including, a reference mark representing a reference position at which a reel strip is to be applied, the reel strip on which a plurality of symbols are applied and which is provided on an annular peripheral face thereof, and includes a positioning mark provided on the reel strip for effecting alignment between the positioning mark and the reference mark, a rotational position sensor for sensing a predetermined rotational position of the reel, and a drive unit for operatively rotating the reel, wherein at least two of the reel strip differ in terms of relative position in the spinning direction of the reel between the symbols on the reel strip and the corresponding positioning mark, and wherein when the respective reel come to a standstill at the predetermined rotation positions, positions of respective symbols defined between the reel corresponding to the at least two reel strips are shifted from each other in the spinning direction.

In this game machine, when respective rotary members are brought to a standstill at rotational positions detected by a rotational position sensor, not all symbols on the respective rotational members which come to the predetermined positions on the main display unit are aligned with each other; at least two symbols are minutely shifted from each other in the spinning direction. In at least two rotary members which cause the positions of the symbols to shift from each other, if a reel strip of inappropriate type is applied to any one of the two rotary members, a shift pattern of symbols at the predetermined position on the main display unit is changed. Since the positions of positioning marks on the respective reel strips are caused to differ in the spinning direction, if a reel strip of inappropriate type is applied on a reel, the applied position of the tape is minutely shifted. Therefore, an error in the type of reel strip applied on at least one of the two rotary members can be identified readily on the basis of a change in the shift pattern of symbols at the predetermined position on the main display unit; e.g., a winning line.

Even when the reference marks provided on at least these two rotary members are at the same locations, the shift pattern changes in accordance with a difference in positions of the positioning marks, which is caused when a reel strip of inappropriate type is applied on a reel.

(2) The game machine according to (1), wherein the respective rotational position sensor senses sections to be detected provided on corresponding reels, thereby senses the predetermined rotational positions, and the reels corresponding to at least two of the reel strips differ in terms of an angle formed between the symbols on the reel strip and the section to be detected, so that positions of respective symbols on rotation paths are shifted from each other in the spinning direction.

In this game machine, at least two rotary members differ in terms of an angle formed between symbols on the reel strip applied to the rotary member and the detection to be detected provided on the rotary member. The positions of the respective symbols on the rotary members that have come to a standstill at a predetermined position detected by the rotational sensor are shifted from each other in the spinning direction of the rotary members. By means of such a configuration, the two rotary members are manually spun until the sections to be detected provided on the respective rotary members assume the attitude at which the sections are detected by the rotary member sensor, thereby stopping the rotary sections at the predetermined rotational positions. Hence, an error in the type of the reel strip applied on one of at least two rotary members can be readily identified without involvement of the trouble of causing the stop control unit to operate so as to stop the rotary members at the predetermined rotational positions.

The positions of the symbols are shifted from each other in the spinning direction by means of causing at least two of the rotary members to differ in relative position. However, in addition to a change in the relative position, the positions of the sections to be detected may be changed minutely.

(3) The game machine according to (1), wherein all the reel strips differ in terms of the relative position in the spinning direction, and when the respective reels come to a standstill at the predetermined rotation positions, positions of respective symbols on rotation paths are shifted from each other in the spinning direction.

In this game machine, when the rotary members are brought to a standstill at the rotational positions detected by the rotational position sensor, symbols of the respective rotary members, which come to predetermined positions on the main display unit, are not aligned with each other in the horizontal direction; the symbols are minutely shifted from each other in the spinning direction. For instance, in the case of a main display unit having three rotary members disposed in the left, center, and right positions, respectively, the positions of the symbols located at the predetermined position, such as a winning line, are shifted from each other by one-third an interval between symbols (hereinafter called a "symbol interval") in the spinning direction. If a reel strip for a right rotary member is used for the left rotary member, the shift pattern is changed. Hence, occurrence of an error can be readily identified. Even when the reel strip has been erroneously applied to the left rotary member, the shift pattern is changed. Hence, occurrence of an error can be readily identified. Hence, an error in the types of reel strips applied on all the rotary members can be readily identified.

(4) The game machine according to (3), wherein all the rotational position sensor sense the same rotational positions of the reels; and, when all the rotary members come to a standstill at the rotational positions, the reference marks are stopped at identical locations in a spinning direction.

In this game machine, identical rotational positions are detected by a rotational position sensor for all the rotary members. Further, reference marks are provided at identical locations on the rotary members in the spinning direction. By means of such a configuration, a combination of the rotary member and the rotational position sensor can be used for all the spinning devices. The shift pattern of symbols located at the predetermined location on the main display unit is dependent only on the positions of the positioning marks provided on the reel strips. Hence, even when a rotary member having a reel strip that has already been applied thereon is erroneously attached to the game machine main body, the shaft pattern of symbols appearing at the predetermined location is changed, thereby enabling easy identification of the error.

(5) The game machine according to (3) further comprising a stop control unit for controlling stoppage of the respective reels at detection timing defined by the corresponding rotational position sensor, wherein the stop control unit causes mutual shifting of spin stop timings of the reels determined by the detection timings of the rotation position sensor, so as to display the symbols of the respective reels at the predetermined positions on the main display unit while being aligned with each other.

In this game machine, the rotational stop positions (i.e., rotational stop angles) are reversely shifted by only the amount corresponding to that by which the positioning marks on the reel strips of the respective rotary members have been shifted. As a result, the respective rotary members can be stopped at rotational angles such that symbols are aligned at a predetermined location on the main display unit. If a reel strip of inappropriate type is applied to any one of the rotary members or if any one of the rotary members is attached to a wrong position, symbols on the respective rotary members are not aligned with each other at the predetermined position on the main display unit. Hence, occurrence of such an error can be readily identified. Further, an operation for determining whether or not the symbols located at the predetermined position are aligned with each other is easier than a task of ascertaining whether or not a predetermined shift pattern has been achieved. Hence, occurrence of an error can be identified.

(6) A game machine including:

a main display in which a plurality of reels, rotatable in a spinning direction, are disposed side by side, each of the plurality of reels including, a reference mark representing a reference position at which a reel strip is to be applied, wherein the reel strips differ in terms of a relative position in the spinning direction between symbols on the reel strip and the positioning mark, the reel strip on which a plurality of symbols are applied and which is provided on an annular peripheral face thereof, and includes a positioning mark provided on the reel strip for effecting alignment between the positioning mark and the reference mark, a rotational position sensor for sensing a predetermined rotational position of the reel, and a drive unit for operatively rotating the reel, wherein the reference marks respectively provided on the reels are provided at the same locations on the reels in the spinning direction, wherein the respective rotational position sensors sense rotational positions of the rotary members, which differ from each other, such that the respective rotational position sensor senses the predetermined locations in the corresponding reels at a timing at which the respective symbols on rotational paths assume the same positions on the reels.

In this game machine, when the respective rotary members are brought to a standstill at identical rotational positions, not all symbols on the respective rotary members are aligned with each other at a predetermined position of the main display unit for reasons of the positioning marks on the reel strips being shifted from each other in the spinning direction. As a result, the symbols are minutely shifted from each other in the spinning direction. The rotational position sensor of the respective spinning devices are arranged to detect different rotational positions, respectively. When the respective rotary members have come to a standstill at corresponding rotational positions, the symbols on the respective rotary members are aligned with each other. By means of such a configuration, if a reel strip of inappropriate type is applied on any one of the rotary members, only the symbol on that reel strip is minutely shifted from the predetermined position in the spinning direction, for reasons of a misalignment of the positioning mark of that reel strip. Therefore, an error in the type of the reel strip from among all the reel strips applied on the rotary members can be readily identified. With regard to the symbols on the respective rotary members stopped at the predetermined position on the main display unit, a determination is made as to whether or not the symbols are aligned with each other as in the case of the game machine of (5), rather than as to occurrence of a change in the shift pattern as performed in the game machines of (1) and (2). Hence, an error in the type of the applied symbol plate can be identified more easily than in the case of the game machines of (1), (2), and (3). Moreover, the rotary members can be stopped such that symbols are aligned with each other at the predetermined location without performing a stop control operation for shifting the rotation stop timings of the respective rotary members as is performed in the game machine of (5).

(7) A display apparatus comprising:

a main display in which a plurality of reels, rotatable in a spinning direction, are disposed side by side, each of the plurality of reels including, a reference mark representing a reference position at which a reel strip is to be applied, the reel strip on which a plurality of symbols are applied and which is provided on an annular peripheral face thereof, and includes a positioning mark provided on the reel strip for effecting alignment between the positioning mark and the reference mark, a rotational position sensor for sensing a predetermined rotational position of the reel, and a drive unit for operatively rotating the reel, wherein at least two of the reel strips differ in terms of a relative position in the spinning direction between symbols on each of the reel strip and the positioning mark, and wherein when the respective reels come to a standstill at the predetermined rotation positions, positions of respective symbols on rotation paths corresponding to at least two reel strips are shifted from each other in the spinning direction.

In the display device, on the basis of a change in the shift pattern of symbols appearing at a predetermined location on the main display unit; e.g., a display window, a difference in types of reel strips applied on at least two rotary members can be readily ascertained.

BRIEF DESCRIPTION OF DRAWINGS

FIG. 8 is an exploded perspective view showing a portion of a reel employed in the slot machine;

FIG. 9 is a front view partially showing a reel tape to be wrapped around a reel framework of the reel;

FIG. 10 is a perspective view of a backlight device of the reel when viewed from the front;

FIG. 14 is a table showing an example data table to be used for controlling stoppage of a center reel;

FIG. 15 is a table showing an example data table to be used for controlling stoppage of a right reel;

FIG. 22 is an example data table to be used in controlling stoppage of the left reel of the related-art slot machine;

FIG. 23 is an example data table to be used in controlling stoppage of the center reel of the related-art slot machine; and FIG. 24 is an example data table to be used in controlling stoppage of the right reel of the related-art slot machine.

DETAILED DESCRIPTION OF PREFERRED EMBODIMENTS

An embodiment of a slot machine serving as a game machine to which the invention is applied will be described hereinbelow.

Figure 3:
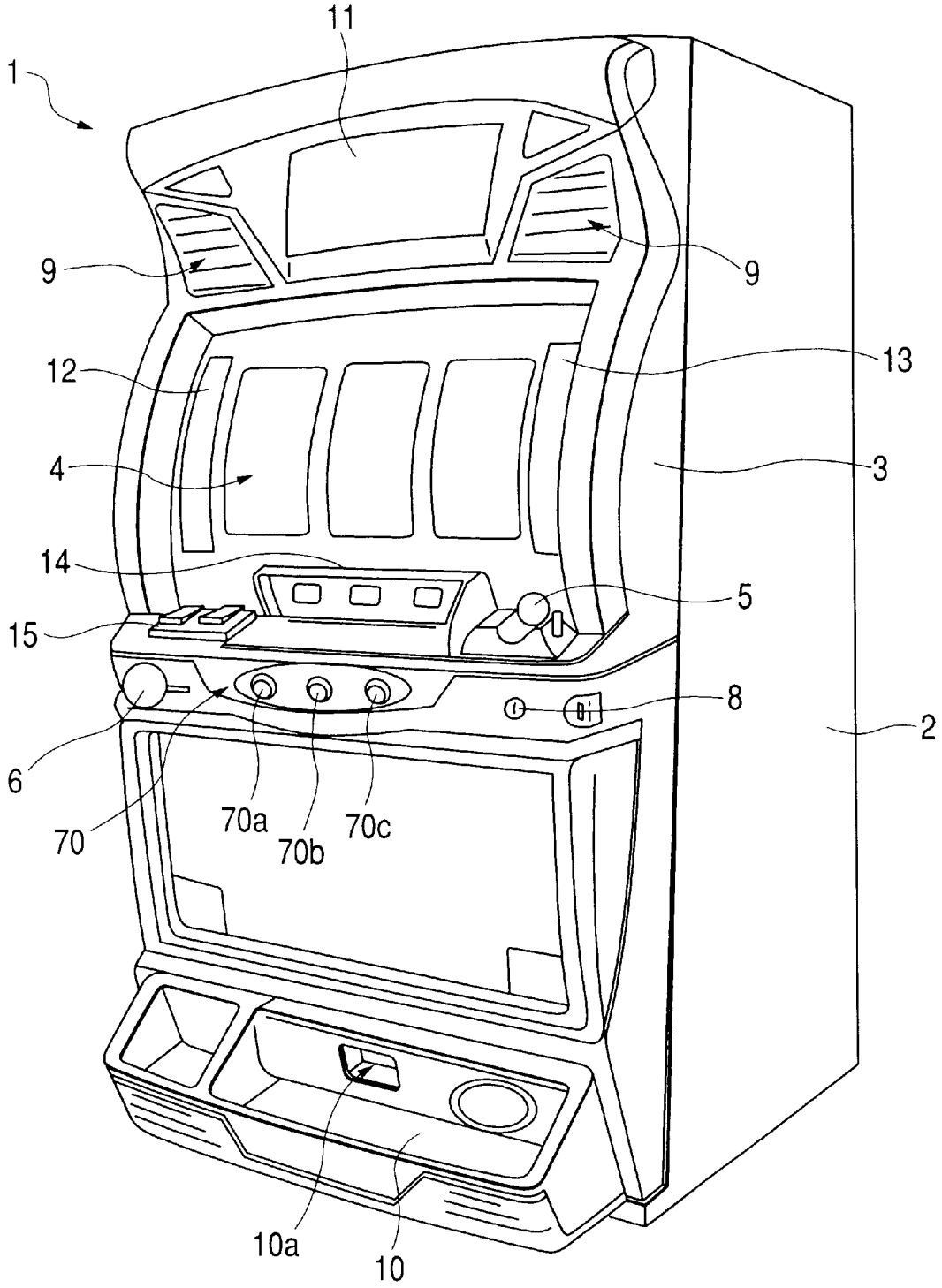
FIG. 3 is an external perspective view of a slot machine of an embodiment.

First, the basic configuration of the slot machine of the embodiment will be described. FIG. 3 is an external perspective view of the slot machine according to the embodiment. The slot machine 1 has a box-shaped housing 2, and a front panel 3 reclosably attached to the front of the housing 2. Provided on the front panel 3 are display windows 4, each constituting a portion of a corresponding reel unit serving as a main display unit; a medal insert slot 5; a start lever 6; a stop button unit 70; a credit settlement button 8; speakers 9; a medal receiver 10 having a medal payout port 10*a*; a liquid-crystal display section 11; a line display section 12; a game status display section 13; a count display section 14; and a BET operation section 15. The stop button unit 70 is constituted of stop buttons 70*a*, 70*b*, and 70*c* provided at uniform intervals in a horizontal direction. Buttons having lamp functions are used for these stop buttons.

Figure 4:
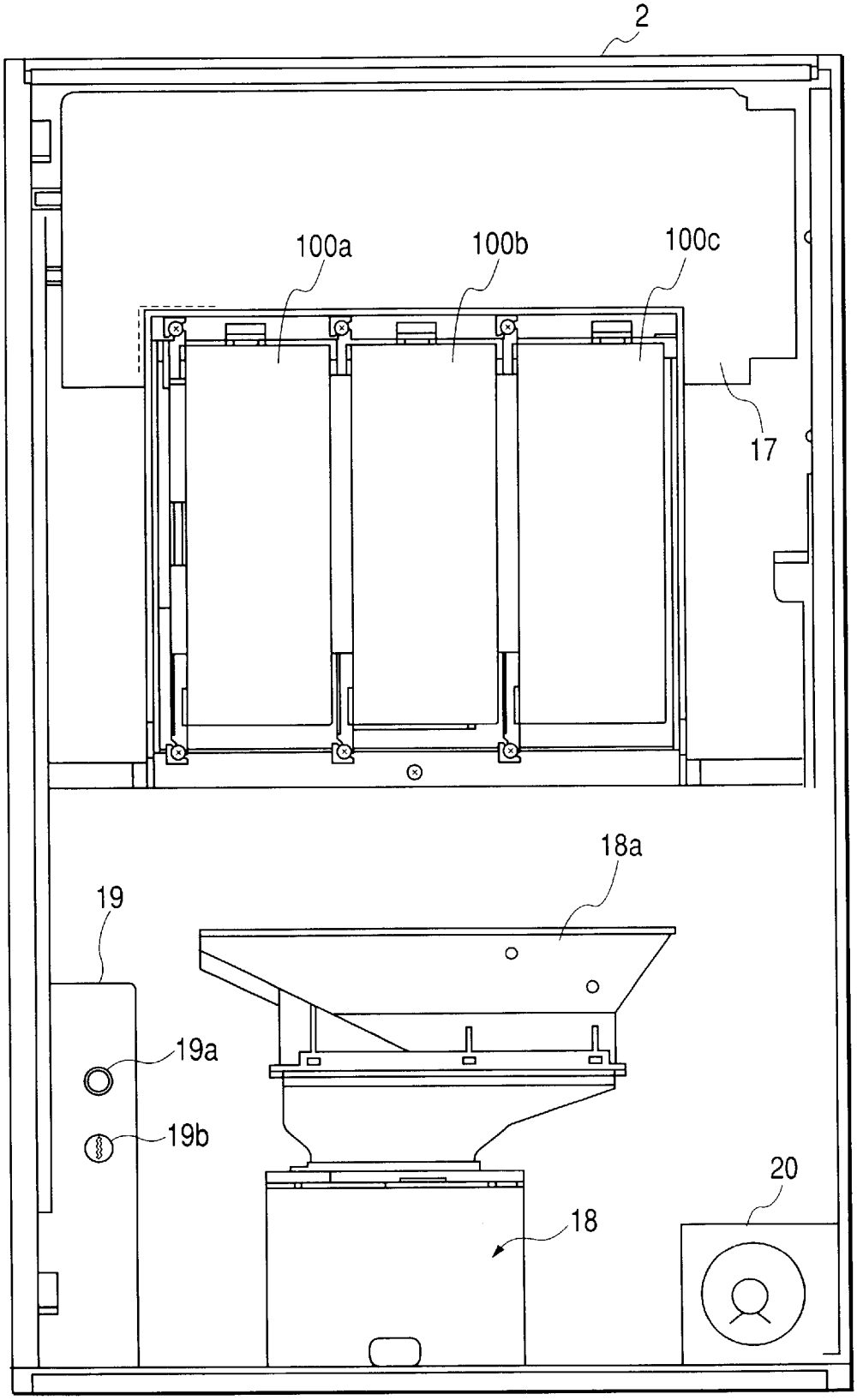
FIG. 4 is a schematic block diagram showing an internal structure of the slot machine.
Figure 5A:
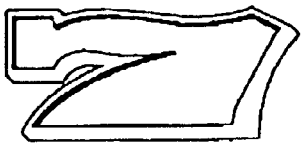
FIGS. 5A to 5G are block schematic diagrams showing symbols to be provided on the respective reels of the slot machine.
Figure 5B:
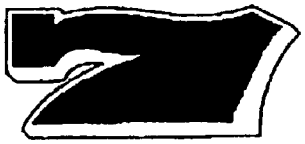
Figure 5C:
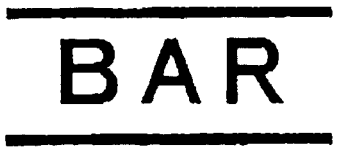
Figure 5D:
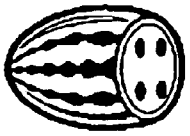
Figure 5E:
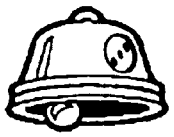
Figure 5F:
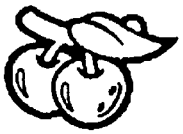
Figure 5G:
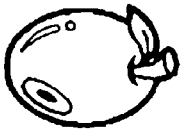

FIG. 4 is a schematic block diagram showing the internal structure of the slot machine 1. Incorporated into the housing 2 are three reels 100*a*, 100*b*, and 100*c*. Each of the reels is constituted of an unillustrated reel strip, on whose outer circumferential surface a plurality of symbols are printed, and a reel framework around which the reel strip is wrapped. Further, the housing 2 houses a main control circuit board 17 in which electronic circuitry is constituted of a CPU, ROM, and other various electronic components; a medal payout device 18 having a medal hopper 18*a* capable of housing a large number of medals; a setting operation section 19 having a reset switch 19*a* and a stage setting key switch 19*b*; and an internal speaker 20. The reset switch 19*a* and the stage setting key switch 19*b* are for setting a sampling table to be described later such that the probability of occurrence of a win, such as a "big win" or "medium win," becomes high or low.

The reels 100*a*, 100*b*, and 100*c* (hereinafter referred to also as "left, center, and right reels"), which also serve as rotary devices, are rotationally driven by non-illustrated drive motors, each motor being constituted of a stepping motor. Seven types of symbols shown in FIGS. 5A through 5G; that is, 21 symbols, are printed in a predetermined sequence. The symbols are hereinafter called "BLUE 7," "RED 7," "BAR," "WATERMELON," "BELL," "CHERRY," and "PLUM".

Figure 6:
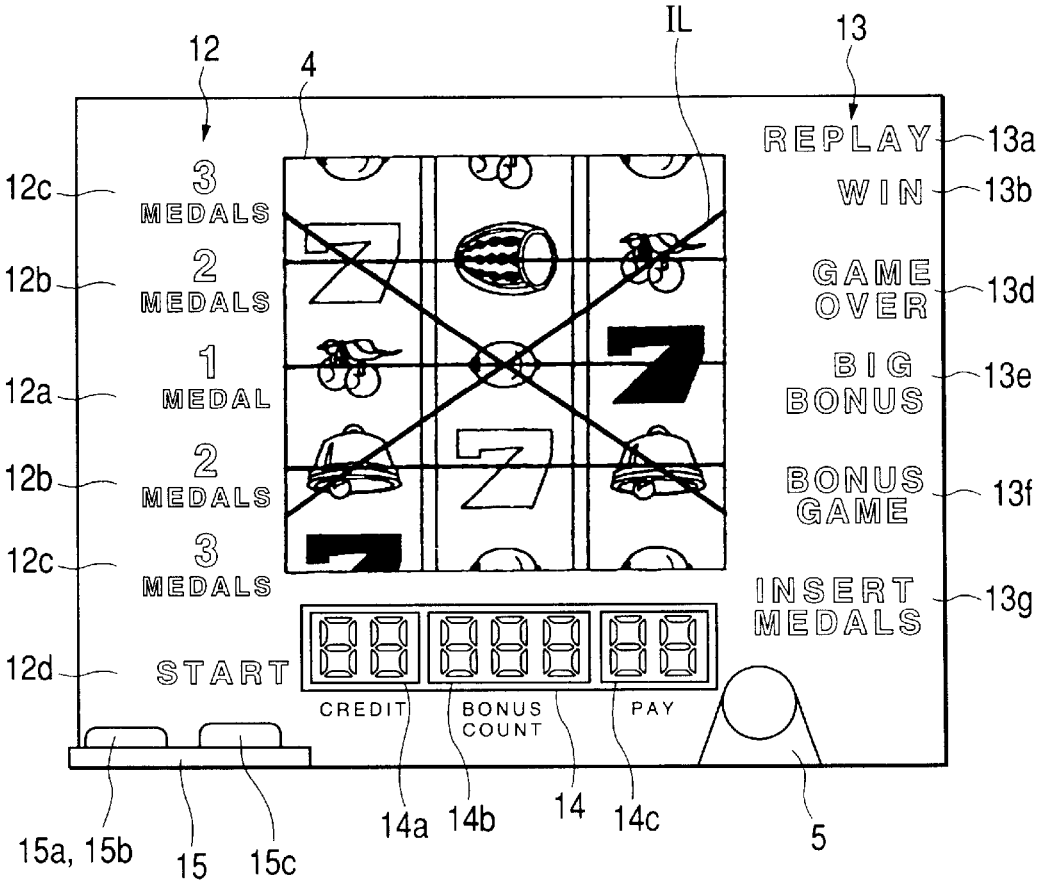
FIG. 6 is a detailed front view showing a portion of a front panel of the slot machine.

FIG. 6 is a detailed front view, showing a portion of the front panel 3. As shown in the drawing, symbols on about three frames at a predetermined rotational position of each of the reels 100*a*, 100*b*, 100*c* are visually observed by way of the respective display windows 4. Five winning lines IL are drawn on the display windows 4 so as to extend across the reels 100*a*, 100*b*, and 100*c*. The five winning lines represent combinations of symbols; namely, an upper horizontal alignment, a center horizontal alignment, a lower horizontal alignment, a right upwardly-slanting alignment, and a right downwardly-slanting alignment. When a "winning combination," which is a predetermined combination of symbols, is established along a winning line, a reward, such as payment of medals to the player or granting of the right to player a replay game, is given to the player. Although the slot machine 1 according to the embodiment is provided with five winning lines, the number of winning liens may be increased or decreased.

The line display section 12 has a ONE-MEDAL lamp 12*a*, two TWO-MEDALS lamps 12*b*, two THREE-MEDALS lamps 12*c*, and a start lamp 12*d*. The ONE-MEDAL lamp 12*a* is dispose data position on an extension of the center horizontal winning line from among the five winning lines provided on the display windows 4. The two TWO-MEDALS lamps 12*b* are provided at positions on extensions of the upper and lower horizontal winning lines. Further, the two THREE-MEDALS lamps 12*c* are provided at positions on extensions of the right upwardly-slanting and right downwardly-slanting winning lines.

The count display section 14 has a credit indictor 14*a*, a bonus count indicator 14*b*, and a payout indicator 14*c*. The BET operation section 15 has a ONE-BET button 15*a*, a TWO-BET button 15*b* (located at a position away from the viewer), and a MAX BET button 15*c*. The game display section 13 has a replay lamp 13*a*, a win lamp 13*b*, a game-over lamp 13*d*, a big bonus (abbreviated as BB; the same convention also applies to other, corresponding descriptions) lamp 13*e*, a regular bonus (abbreviated as RB; the same convention also applies to other, corresponding descriptions) 13*f*, and a medal insert lamp 13*g*. When a "small win" has been achieved as a result of three "BELL" symbols having been aligned along a winning line, the winning lamp 13*b* is illuminated. In contrast, when a "big win" or "medium win" has been achieved, the BB lamp 13*e* or the RB lamp 13*f* is illuminated along with the winning lamp 13*b*. When a game is not started and a medal credit to be described later has less than 50 medals, the medal insert lamp 13*g* blinks, thereby informing the player that the player can insert medals.

Figure 1:
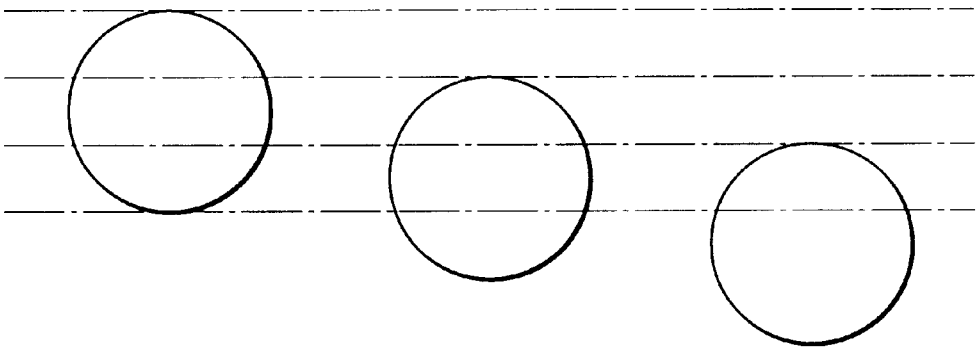
FIG. 1 is a schematic diagram showing an example of a shift pattern of symbols in a game machine of the invention.
Figure 2:
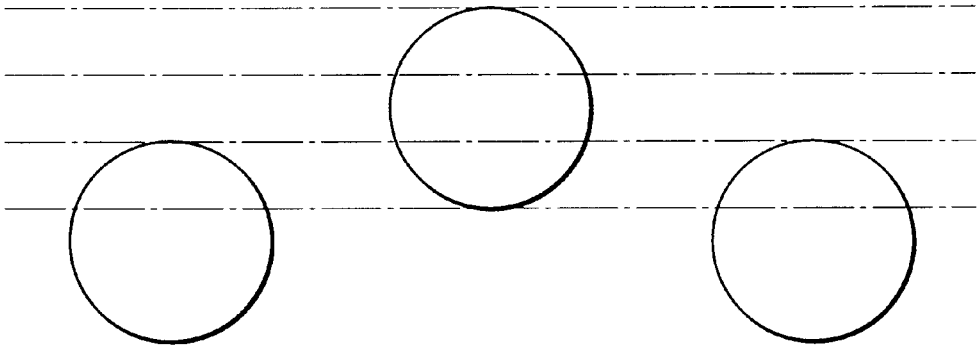
FIG. 2 is a schematic diagram showing an example of a shift pattern which has been changed for reasons of an error in a reel strip.

When the player inserts unillustrated medals into the medal insert slot 5, the medals fall into the medal hopper 18*a* (see FIG. 2) by way of an unillustrated passage. The passage is provided with a pitfall slot for returning a medal smaller than a specified size to the medal payout port 10*a* (see FIG. 1); a medal block solenoid which blocks passage of a medal and returns the medal to the medal payout port 10*a* or allows feeding of a medal to the medal hopper; and a medal insert sensor constituted of a photosensor for sensing the medals that have passed through the passage on a per-medal basis.

When the inserted medal falls onto the medal hopper 18*a* and is officially accepted after having been sensed by the medal insert sensor, the ONE-MEDAL lamp 12*a* is illuminated, and the start lamp 12*d* blinks. Illumination of the ONE-MEDAL lamp 12*a* indicates that only one center horizontal winning line from among the five winning lines has become valid. If a winning combination is not established along the winning line that has been made valid and if a winning combination has been established along another winning line, a win is not achieved. Blinking of the start lamp 12*d* indicates that start of a game is allowable. If the player actuates the start lever 6 (see FIG. 1) in this state, the reels 100*a*, 100*b*, and 100*c* start spinning. The lesser the number of valid winning lines, the lower the probability of occurrence of a win. In normal times, the player inserts additional medals for increasing the probability of occurrence of a win before actuating the start lever 6. Hereupon, the TWO-MEDALS lamps 13*b* or the THREE-MEDAL lamps 13*c* are illuminated, depending on the number of additional medals, thereby rendering all the five winning lines valid.

When the player actuates the start lever 6, the CPU of the main control board 17 first extinguishes blinking of the start lamp 12*d*, thereby starting spinning of the reels 100*a*, 100*b*, and 100*c*. Predetermined rotational positions of the reels 100*a*, 100*b*, and 100*c* are detected by an unillustrated reel position sensor. An unillustrated random number generation circuit generates a random number at a predetermined cycle and outputs the thus-generated number as a random number signal. The CPU of the main control circuit board 17 checks data pertaining to the random number signal sent immediately after initiation of spinning of the reels against the sampling table stored in the ROM. The sampling table describes association among random numbers, winning modes (e.g., a "small win," an "intermediate win," and a "big win"), and failures. By means of such an association, various winning modes are internally generated at predetermined probabilities, or a failure arises at a predetermined probability. The random number generation circuit, the ROM, and the CPU constitute a sampling unit.

The CPU of the main circuit board 17 determines rotational speeds of the reels 100*a*, 100*b*, and 100*c* in accordance with signals output from the respective reel position sensors. Immediately after having spun, the reels 100*a*, 100*b*, and 100*c* are spinning at unstable speeds. Even if the player has actuated the stop buttons 70*a*, 70*b*, and 70*c* (see FIG. 1), stoppage of the reels cannot be controlled accurately. For this reason, the CPU does not accept any signals output from the stop buttons 70*a*, 70*b*, and 70*c* until the rotational speeds of the respective reels (100*a*, 100*b*, and 100*c*) become stable at a predetermined speed. When the rotational speeds have become stable, lamps (LEDs to be described later) of the stop buttons 70*a*, 70*b*, and 70*c* are illuminated, thereby enabling pressing of the buttons.

When the player has pressed the stop buttons 70*a*, 70*b*, and 70*c*, the reels 100*a*, 100*b*, and 100*c* are appropriately stopped under control on the basis of the pressing timings and the result of sampling operation. More specifically, even when the symbols corresponding to the winning mode determined through internal sampling operation are not aligned on the valid winning line at the timing when the stop buttons 70*a*, 70*b*, and 70*c* are pressed, a stop control operation is performed such that the symbols are drawn to the winning line to the extent possible by means of continuously spinning the reels up to a maximum of five frames. If no winning mode has been selected through internal sampling operation, a control operation is performed such that at least one of the reels draws a different symbol so as to prevent establishment of a "winning combination"; that is, a combination of symbols corresponding to the winning mode, along a valid winning line.

When a "winning combination" corresponding to any of the winning modes is established along a valid winning line, a win is achieved, whereupon any one of the replay lamp 13*a*, the win lamp 13*b*, the BB lamp 13*e*, and the RB lamp 13*f*, which corresponds to the win, is illuminated. A medal lamp situated beside the winning line along which the "winning combination" has been established blinks. For instance, when a "BELL winning combination" has been established along a lower horizontal winning line, the win lamp 13*b* is illuminated, and a lower one of the two TWO-MEDALS lamps 12*b* blinks.

When a win has been achieved, the number of medals to be paid corresponding to the winning mode is displayed in the payout indicator 14*c* of the count display section 14. The amount of medal credit appearing in the credit indicator 14*a* is increased by the amount corresponding to the medals paid. When the amount of medal credit being increased has achieved a value of 50, the amount of medal credit is not increased any further. Instead, the remaining medals are paid to the player by means of the medal payout device 18.

If the player presses any one of the ONE-BET button 15*a*, the 2-BET button 15*b*, and the MAX BET button 15*c* while the medal credit assumes a value of one or more, there is performed the same processing as that performed when one medal, two medals, or three medals are received. Then, the amount of medal credit is subtracted accordingly. If the amount of medal credit is smaller than the number of medals corresponding to the pressed BET button, only winning lines corresponding to the amount of medal credit are made valid. Alternatively, an accessory card unit may be attached to the slot machine 1. When a valuable medium, such as a pre-paid card, is inserted into the card unit, the amount of medal credit may be increased by the amount corresponding to the value of the medium, or medals may be paid into the medal receiver.

A game status arising in the slot machine can be roughly divided into a basic game which arises in normal times and a special game which has been switched on the basis of occurrence of a "medium win" called a regular bonus or a "big win" called a big bonus. The special game status is further classified into an RB status which arises as a result of achievement of an RB, and a BB status which arises as a result of achievement of a BB. Further, the BB status is classified into a non-RB status during a BB and an RB status during a BB.

When a win has been achieved through an RB in a basic game status, the game status is switched to an RB status A jackpot game is offered, wherein betting of only one medal is accepted, and only a center horizontal winning line is made valid. In the jackpot game, only two winning modes are determined; namely, a "win," and a "failure." There is used a custom-designed sampling table which enables occurrence of a "win" at an extremely high probability through internal sampling operation. For this reason, a "win" (a JAC win) arises at an extremely high probability, whereby a large number of medals are paid. When a JAC win has been achieved eight times in a jackpot game or 12 jackpot games have been played, the game status returns to a basic game status.

When a win has been achieved in a basic game status through a BB, the game status is switched to a non-RB in a BB. In this state, there is employed a custom-designed sampling table which enables occurrence of an RB or various "small wins" at an extremely high probability through internal sampling operation. When a win has been achieved through an RB, the game status is further switched to an RB during a BB, and the foregoing jackpot game is offered. When an accumulated number of games played in the non-RB in the BB (i.e., an accumulated number of games played in a single BB) has achieved 30 times or when the third RB in the BB has been completed, the game status returns from the BB to the basic game status. In such a BB, a win is achieved through the first through third RB games, and a "small win" is achieved at an extremely high probability in the non-RB in the BB. Hence, the number of medals paid is greater than that paid in the RB status.

Table 1 provided below shows the relationship between game statuses which are to arise in the slot machine 1, various types of "winning combinations," and the number of medals paid.

TABLE 1

| GAME STATUS | | WINNING MODE | WINNING COMBINATION | COMBINATIONS OF SYMBOLS REEL 16a | REEL 16b | REEL 16c | NUMBER OF MEDALS TO BE PAID |
|---|---|---|---|---|---|---|---|
| BASIC GAME | | BIG WIN (BB) | RED 7 WINNING COMBINATION | RED 7 | RED 7 | RED 7 | 15 MEDALS |
| | | | BLUE 7 WINNING COMBINATION | BLUE 7 | BLUE 7 | BLUE 7 | 15 MEDALS |
| | | MEDIUM WIN (RB) | BAR WINNING COMBINATION | BAR | BAR | BAR | 15 MEDALS |
| | | SMALL WIN | CHERRY WINNING COMBINATION | CHERRY | ANY (*) | ANY (*) | 2 MEDALS |
| | | | WATERMELON WINNING COMBINATION | WATERMELON | WATERMELON | WATERMELON | 5 MEDALS |
| | | | BELL WINNING COMBINATION | BELL | BELL | BELL | 8 MEDALS |
| | | | PLUM WINNING COMBINATION | PLUM | PLUM | PLUM | 0 (REPLAY GAME) |
| SPECIAL GAME | RB OR RB IN BB | WIN | PLUM WINNING COMBINATION | PLUM | PLUM | PLUM | 15 MEDALS |
| | NON-RB IN BB | MEDIUM WIN (RB IN BB) | PLUM WINNING COMBINATION | PLUM | PLUM | PLUM | 15 MEDALS |
| | | SMALL WIN | CHERRY WINNING COMBINATION | CHERRY | ANY (*) | ANY (*) | 2 MEDALS |
| | | | WATERMELON WINNING COMBINATION | WATERMELON | WATERMELON | WATERMELON | 5 MEDALS |
| | | | BELL WINNING COMBINATION | BELL | BELL | BELL | 8 MEDALS |

* Any symbol is acceptable.

As shown in Table 1, in a basic game status, three types of "small wins" are defined as one of winning modes; that is, a "CHERRY winning combination" consisting of "CHERRY-ANY-ANY," a "WATERMELON winning combination" consisting of "WATERMELON-WATERMELON-WATERMELON," and a "BELL winning combination" consisting of "BELL-BELL-BELL." Further, a BB winning mode is also defined; namely, a "BLUE 7 winning combination" consisting of "BLUE7-BLUE7-BLUE7," and a "RED 7 winning combination" consisting of "RED7-RED7-RED7."

Additionally, an RB winning mode is defined; that is, a "BAR winning combination" consisting of "BAR-BAR-BAR," and a replay corresponding to a "PLUM winning combination" consisting of "PLUM-PLUM-PLUM." Here, "ANY" signifies that any symbol is acceptable. As shown in Table 1, a "PLUM winning combination" corresponding to a "REPLAY small win" in a basic game status corresponds to a "win" in an RB status (jackpot game) and to an RB in a non-RB status in a BB.

Figure 7:
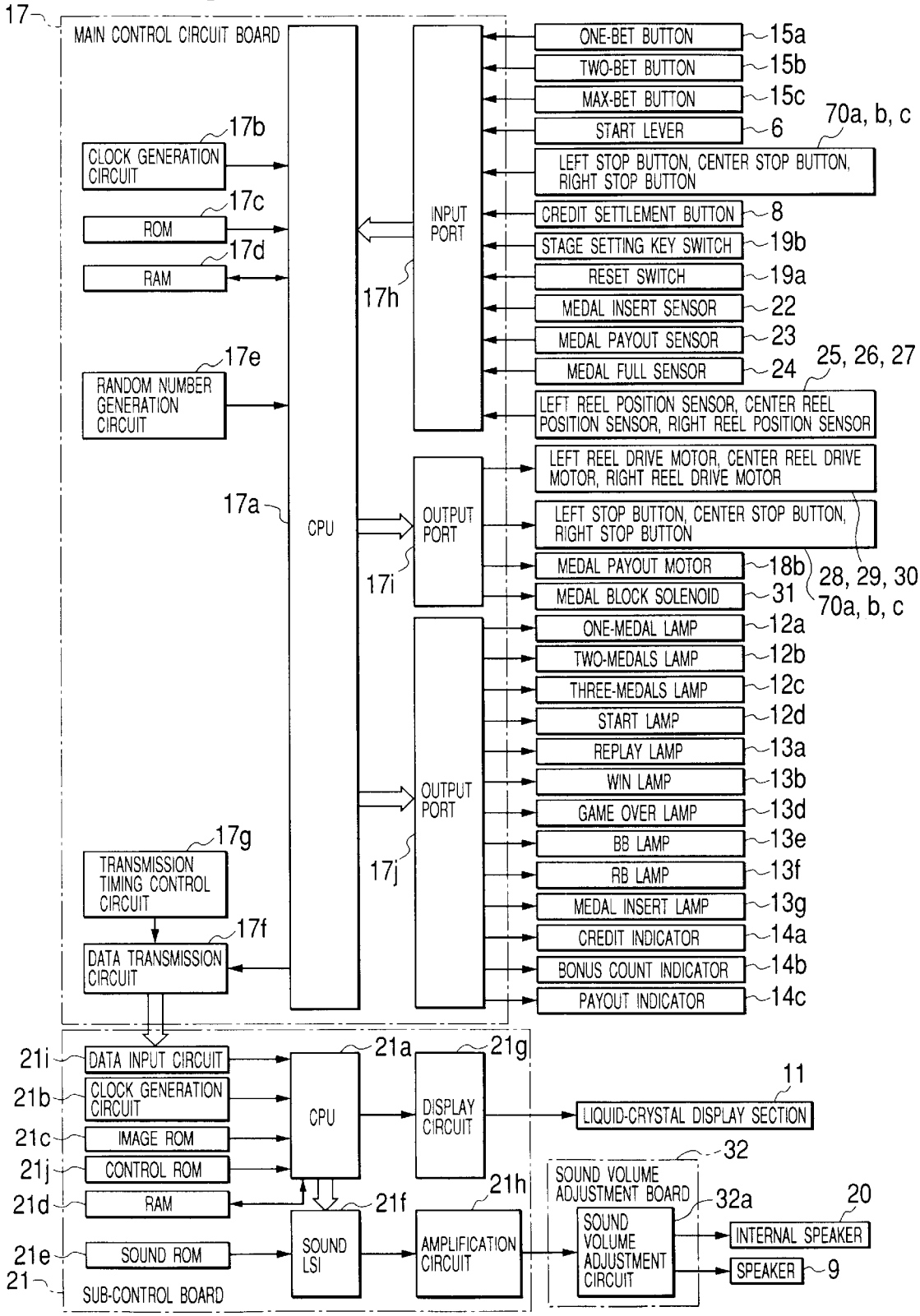
FIG. 7 is a block diagram showing a portion of an electric circuit of the slot machine.

FIG. 7 is a block diagram showing a portion of an electric circuit of the slot machine 1. As illustrated, the slot machine 1 has a sub-control circuit board 21, as well as the main control circuit board 17.

The main control circuit board 17 has a CPU 17*a*, a clock generation circuit 17*b*, ROM 17*c*, RAM 17*d*, a random number generation circuit 17*e*, a data transmission circuit 17*f*, a transmission timing control circuit 17*g*, an input port 17*h*, and an output port 17*i*. The clock generation circuit 17*b* outputs a clock signal of predetermined frequency to the CPU 17*a*. The ROM 17*c* stores data, such as various control programs and sampling tables to be described later, and outputs the data to the CPU 17*a*. The RAM 17*d* temporarily stores variable data computed by the CPU 17*a*. The random number generation circuit 17*e* generates a random number at a predetermined cycle and outputs to the CPU 17*a* data pertaining to the random number.

The CPU 17*a* receives, by way of the input port 17*h*, signals output from the ONE-BET button 15*a*, the TWO-BET button 15*b*, the MAX-BET button 17*c*, the start lever 16, the stop buttons 70*a*, 70*b*, and 70*c*, the credit settlement button 8, the stage setting switch 19*b*, the reset switch 19*a*, the medal insert sensor 22, the (left) reel position sensor 25, the (center) reel position sensor 26, and the (right) reel position sensor 27. Moreover, the CPU 17*a* receives signals output from a medal payout sensor 23 and a medal full sensor 24. The medal payout sensor 23 senses medals paid by the medal payout device 18 one by one and outputs a sensing signal to the CPU 17*a*. On the basis of the signal output from the medal payout sensor 23, the CPU 17*a* stops driving of a medal payout motor to be described later, thereby adjusting the number of medals paid by the medal payout device 18. Upon detection of the upper limit of the level of the medals stored in the medal hopper 18*a*, the medal full sensor 24 outputs a full signal to the CPU 17*a*. Upon receipt of the full signal, the CPU 17*a* temporarily suspends various control operations, thereby displaying information about a medal full error on the liquid-crystal display section 11.

The CPU 17*a* is arranged to output, by way of the output port 17*i*, control signals to the (left) reel drive motor 28, the (center) reel drive motor 29, the (right) reel drive motor 30, a medal payout motor 18*b* of the medal payout device 18, a medal block solenoid 31, the ONE-MEDAL lamp 12*a*, the two TWO-MEDALS lamps 12*b*, the two THREE-MEDALS lamp 12*c*, the start lamp 12*d*, the replay lamp 13*a*, the win lamp 13*b*, the game over lamp 13*d*, the BB lamp 13*e*, the RB lamp 13*f*, the medal insert lamp 13*g*, the credit indication section 14*a*, the bonus count indication section 14*b*, the payout indication section 14*c*, and the stop buttons 70*a*, 70*b*, and 70*c*. In association with progress in a game, the CPU 17*a* outputs an output timing information signal to the data transmission circuit 17*f*. The output timing information signal output to the data transmission circuit 17*f* is temporarily stored herein, and the signal is then output to a data input circuit 21*i* of the sub-control board 21 in response to a signal output from the transmission timing control circuit 17*g*. Control signals to be output from the CPU 17*a* to the stop buttons 70*a*, 70*b*, and 70*c* are for illuminating lamps provided in the respective stop buttons.

The sub-control circuit board 21 is provided on the back of the front panel 3 and has a CPU 21*a*, a clock generation circuit 21*b*, image ROM 21*c*, RAM 21*d*, sound ROM 21*e*, a sound LSI 21*f*, a display circuit 21*g*, an amplification circuit 21*h*, and control ROM 21*j*, as well as the data input circuit 21*i*. In the sub-control circuit board 21, the output timing information signal that has been input to the data input circuit 21*i* is output to the CPU 21*a*. The clock generation circuit 21*b* outputs a clock signal of predetermined frequency to the CPU 21*a*. The image ROM 21*c* stores various control programs and image data and outputs the program or the data to the CPU 21*a*, as required. The RAM 21*d* temporarily stores variable data computed by the CPU 21*a*. The sound ROM 21*e* stores various sound data sets and outputs the data to the sound LSI 21*f*, as required.

The CPU 21*a* loads, from the image ROM 21*c*, image data corresponding to the output timing information signal received from the data input circuit 21*i* and outputs the data to the display circuit 21*g*. Furthermore, a sound output instruction signal corresponding to the output timing information signal is output to the sound LSI 21*f*. The display circuit 21*g* subjects the image data received from the CPU 21*a* to predetermined processing and then outputs the thus-processed data to the liquid-crystal section 11. By means of such an output, a presentation image corresponding to progress in a game and symbols corresponding to a winning mode determined through internal sampling operation are displayed on the liquid-crystal display section 11. The sound LSI 21*f* loads, from the sound ROM 21*e*, the sound data corresponding to the sound output instruction signal received from the CPU 21*a* and outputs the data to the amplification circuit 21*h*. The amplification circuit 21*h* subjects the sound data received from the sound LSI 21*f* to predetermined processing and outputs, by way of a sound volume adjustment circuit 32*a* of a sound volume adjustment board 32, the data to the speakers 9 and the internal speaker 20. By means of the outputs, sound corresponding to a progress in a game is output from the speakers 9 and the internal speaker 20.

FIG. 8 is an exploded perspective view showing portions of the reels 100*a*, 100*b*, and 100*c*. Here, the reels are identical in construction with each other, and hence for the sake of convenience only one reel is shown. Reel frameworks 101*a*, 101*b*, and 101*c*, which serve as rotary members, are formed from a transparent member, such as ABS resin (acrylonitrile butadiene styrene resin). Five spoke sections and a circular ladder section are formed in each of the reel frameworks. The reel framework is similar in shape to a "running wheel," which is an apparatus for use in the keeping of a hamster or a squirrel. The five spoke sections radially extend from respective shaft sections to be connected to the reel drive motors 28, 29, and 30. Sensing plates 103*a*, 103*b*, and 103*c*, which serve as sections to be detected, are provided on single projections of the respective frameworks 101*a*, 101*b*, and 101*c* so as to project toward the inside of the circular ladder sections, respectively. When the reel drive motors 28, 29, and 30 rotate, the reel frameworks 101*a*, 101*b*, and 101*c* spin. Backlight devices 102*a*, 102*b*, and 102*c* for radiating light onto the internal circumferential surfaces of the reel frameworks 101*a*, 101*b*, and 101*c* are fixed so as not to spin along with the reel frameworks. The reel strips 106, which serve as reel strips, are wrapped around the outer peripheral surfaces of the respective reel frameworks 101*a*, 101*b*, and 101*c*. Minute protrusions 105 correspond to marks which are printed on the respective reel strips 106 and will be described later. The minute protrusion 105 is provided in the vicinity of one end of each of the circular ladder sections of the reel frameworks 101*a*, 101*b*, and 101*c* so as to protrude radially outward.

Figure 21:
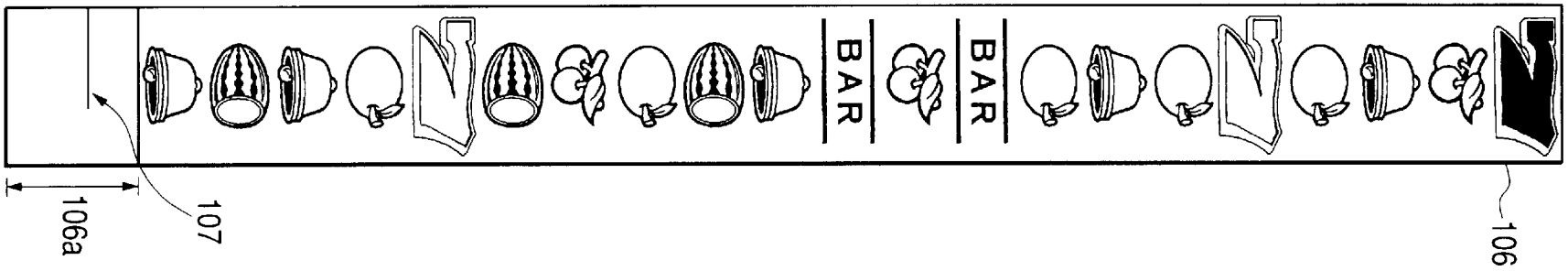
FIG. 21 is a front view showing an example reel tape of the slot machine.

The reel strip 106 is formed from a base material made of light permeable material, such as a light permeable organic resin sheet or film. Seven types of unillustrated symbols (see FIG. 5); that is, 21 symbols, are printed on the back of the base material by means of a known screen printing method. As shown in FIG. 21, an overlap section 106*a* to be superimposed on the extremity of the reel strip 106 is formed at the trailing end (a lower end in the drawing). A background section is formed on areas of the reel strip 106 other than the overlap section 106*a*, where no symbols are printed. In the embodiment, a blue printing material is used for forming a background section. The background is not printed in the overlap section 106*a*. In principle, the overlap section 106*a* remains in the form of a solid light permeable material. A line mark 107 is formed at a predetermined location on the overlap section 106*a* so as to extend straight across the widthwise direction of the tape. The mark 107 serving as a positioning mark is printed along with symbols.

FIG. 9 is a front view partially showing the reel strip 106 which is in the course of being wrapped around each of the reel frameworks 101*a*, 101*b*, and 101*c*. As mentioned previously, the minute protrusion 105 is provided in the vicinity of one end of the circular ladder section of each of the reel frameworks 101*a*, 101*b*, and 101*c* and is to be aligned with the mark 107 printed on the overlap section 106*a* of the reel strip 106. An adhesive material, such as double-sided tape, is attached to the circular ladder section or the surface of the reel strip 106. The reel strip 106 is fixedly wrapped on the circular ladder section while being gradually lapped from the overlap section 101*a* provided at the back edge to the extremity with the adhesive material being interposed between the reel strip and the circular ladder section. As illustrated, prior to wrapping of the reel strip 106, the mark 107 printed on the overlap section 106*a* is positioned so as to be aligned with the protrusion 105 serving as a reference mark on the circular ladder section.

FIG. 10 is a perspective view of the backlight devices 102*a*, 102*b*, and 102*c* when viewed from the front. As illustrated, the inside of each of the backlight devices 102*a*, 102*b*, and 102*c* is separated into three compartments. A light 104 is provided in each of the compartments. Each of the backlight devices 102*a*, 102*b*, and 102*c* illuminates three symbols appearing at the position of the display window 4 from the inside of the reel. By means of radiation, the symbols are illuminated brightly for the player, thus enabling the player to visually ascertain the symbols.

As shown in FIG. 8, the reel position sensors 25, 26, and 27, each being constituted of a transmission photosensor or the like, are provided on the side walls of the respective backlight devices 102*a*, 102*b*, and 102*c*. When the reel frameworks 101*a*, 101*b*, and 101*c* have spun through a predetermined rotational angle, the reel position sensors 25, 26, and 27 detect the sensing plates 103*a*, 103*b*, and 103*c*. On the basis of the result of detection, the CPU (17*a*) controls stoppage of the reel drive motors 28, 29, and 30. In the slot machine of the embodiment, at a moment when the reel position sensors 25, 26, and 27 have detected the sensing plates 130*a*, 130*b*, and 130*c*, the symbols located at the extremities of the respective reel strips 106 are situated along the lower horizontal winning line. A rotational position unit for detecting a predetermined position for reels is constituted by combination of the reel position sensor and the sensing plates. Alternatively, an device which detects predetermined rotational positions of rotary shafts of the reel drive motors may be provided in place of the combination of the reel positions sensors and the sensing plates. Detection of predetermined positions of the rotary shafts of the reel drive motors is identical with detection of predetermined rotational positions of the reels.

Figure 11:
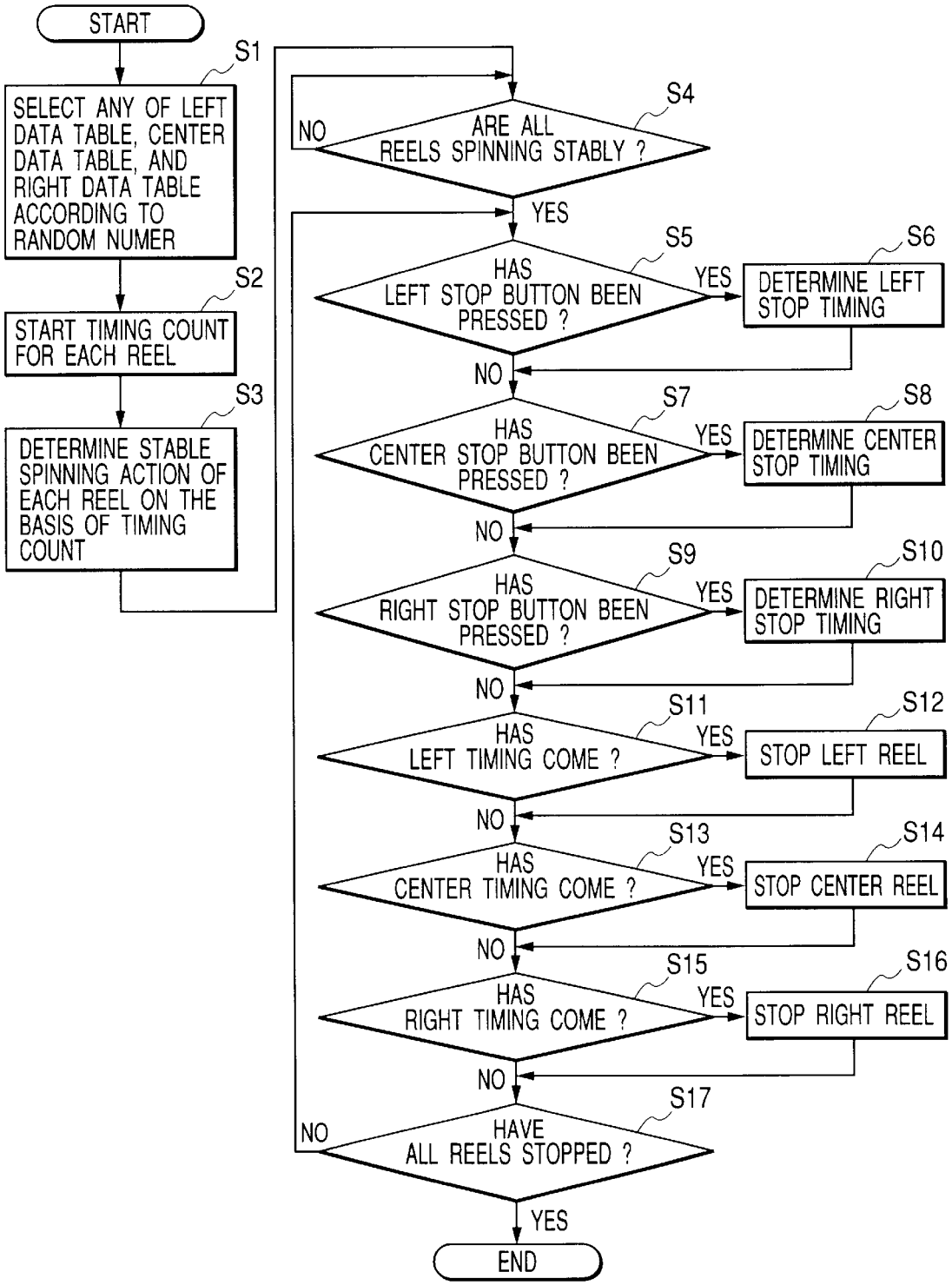
FIG. 11 is a flowchart showing the flow of operation for stopping reels of the slot machine.

FIG. 11 is a flowchart showing the flow of reel stoppage control operation to be performed by the CPU 17*a* serving as a stop control unit. According to the reel stoppage control operation, stop control data tables corresponding to random numbers are selected from a plurality of stop control data tables previously recorded in the RAM 17*d* for the left reel 100*a*, the center reel 100*b*, and the right reel 100*c*, respectively (step 1; a step will be hereinafter abbreviated as "S"). A timing is counted for each of the reels whose spinning operations have been started by means of unillustrated spin start control operation (S2). The timing count operation is a time count operation to be performed from a moment at which the reel position sensors 25, 26, and 27 have transmitted detection signals until the sensors transmit the next detection signals. On the basis of a result of processing, a determination is made as to stabilization of the rotational speed of the left reel 100*a*, that of the center reel 100*b*, and that of the right reel 100*c* (S3). When the rotational speeds of all the reels have become stable (when YES is selected in S4), a determination is made as to whether or not the stop button 70*a* has been pressed (S5). If the stop button 70*a* has been pressed (when YES is selected in S5), a timing at which the left reel 100*a* is to be stopped (a stop timing) is determined on the basis of the timing at which the stop button 70*a* has been pressed and the previously-selected stop control data table (for the left reel) The same control operation is performed for the remaining center reel 100*b* and the right reel 100*c* (S7 to S10), whereby a determination is made as to whether or not the stop timing for the left reel (10*a*) has come (S11). If the stop timing has come, the driving operation of the left reel drive motor 28 is stopped (S12). After the same control operation is performed for the remaining center reel and the right reel (S13 through S16), a determination is made as to whether or not spinning actions of all the reels have been stopped (S17). If any of the reels has not yet come to a standstill (when No is selected in S17), the control flow is looped backed to S5, whereupon determinations as to stoppage of spinning actions of the reels are rendered again. When all the reels has come to a standstill (when YES is selected in S17), the reel stop control operation is completed.

In the slot machine of the embodiment, the reels are spun at a speed of 750 msec/rotation. Twenty-one symbols are printed on each of the reel strips 106 at predetermined pitches. The time required for travel of a symbol of one frame is 35.714 msec.

Before a characteristic construction of the slot machine according to the embodiment is described, a reel stop control operation of the related-art slot machine will be described in more detail. FIG. 22 shows an example of a stop control data table (hereinafter referred to simply as a "data table") to be used for controlling stoppage of the left reel in the related-art slot machine. The data table is for drawing "PLUM" on the left reel 100*a* to the lower winning line when a "PLUM small win" has been achieved through internal sampling operation. In the drawing, a position number indicates the positions of respective symbols from the extremity of the reel strip, such that a symbol having a position number of 1 is located at the furthest extremity of the reel strip 106. Hence, the reel strip 106 is taken up in an endless manner such that the extremity of the reel strip follows a symbol having a position number of 21 ("BELL" in the illustrated example). The reels spin in a direction in which the symbols are moved in a vertically downward direction. In the drawing, a "lower line movement timing" indicates the value of a timing count required when a symbol comes to a standstill precisely at the lower horizontal winning line. When the timing count assumes a value of 0, the symbol having a position number of 1 (RED 7 in the illustrated example) is situated exactly at the lower winning line. As mentioned above, the time required for moving the reel strip for a symbol of one frame is 35.71 msec, and symbols having position numbers of 21 to 2 are sequentially moved to the lower winning line each time the movement time lapses.

A stop operation timing in the drawing indicates a timing count obtained at a point in time when the player has pressed a stop button. As illustrated, when the count assumes a value ranging from 0 to 70 msec, spinning of the left reel is stopped when the timing count has assumed a value of 71.428 msec. Here, a count of 71.428 msec indicates a timing at which PLUM having a position number of 20 is situated at a lower winning line (hereinafter referred to simply as a "lower line"). When a stop button is pressed while the value of the timing count falls within the range from 0 to 70 msec, the symbol (PLUM) having a position number of 21 is drawn to the lower line. Similarly, when the value of the timing count falls within the range from 70-plus to 210, a symbol having a position number of 16 is drawn to the lower line. When the value of the timing count falls within the range from 210-plus to 320, a symbol having a position number of 13 is drawn to the lower line. When the value of the timing count falls within the range from 320-plus to 460, a symbol having a position number of 9 is drawn to the lower line. When the value of the timing count falls within the range from 460-plus to 640, a symbol having a position number of 4 is drawn to the lower line. When the value of the timing count falls within the range from 640-plus to the next 70 (i.e., approximately 820), a symbol having a position number of 20 is drawn to the lower line. When "BAR" having a position number of 16 is drawn, a "PLUM small win" is lost.

FIG. 23 shows an example of the data table used for controlling stoppage of the center reel in the related-art slot machine When no winning mode has been determined through internal sampling operation, the data table is used for drawing any one of the symbols having positions numbers of 4, 9, 13, 16, and 20 to the lower line in order to introduce a display of "a combination of symbols for a failure." The combination of the position numbers is identical with the combination of position numbers assigned to the respective symbols to be drawn on the data table shown in FIG. 22. In other words, the data table shown in FIG. 22 and that shown in FIG. 23 differ from each other in terms of types of symbols to be drawn to the lower line. However, in either table, the symbol assigned the same position number is drawn. As can be seen from a comparison between the drawings, the data tables differ from each other only in terms of arrangement of symbols; they are identical in terms of timings at which the reels are to be stopped.

FIG. 24 is an example data table to be used for controlling stoppage of the right reel in the related-art slot machine. Even in the case of this data table, when no winning mode has been determined through internal sampling operation, the data table is used for drawing any one of the symbols having positions numbers of 4, 9, 13, 16, and 20 to the lower line in order to introduce a display of "a combination of symbols for a failure."

Hence, the data tables shown in FIGS. 22 through 24 differ from each other only in arrangements of the symbols.

The characteristic construction of the slot machine of the embodiment will now be described.

Figure 12A:
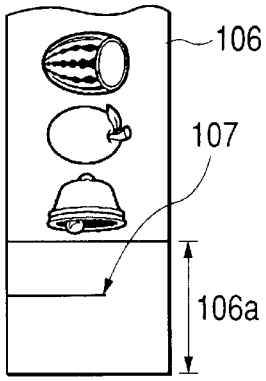
FIGS. 12A to 12C are front views showing the neighborhood of a trailing edge of the left reel tape, that of the center reel tape, and that of the right reel tape.
Figure 12B:
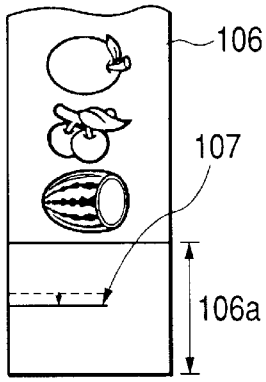
Figure 12C:
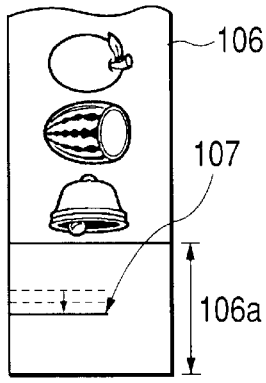
Figure 13:
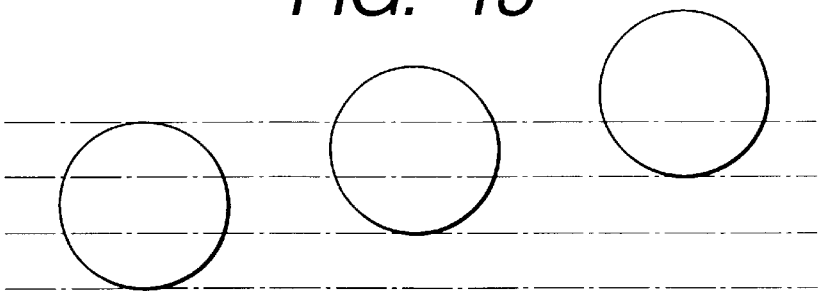
FIG. 13 is a schematic diagram showing a shift pattern of symbols when a reel stop control operation similar to that employed in the related art is performed by the slot machine.

FIG. 12A is a front view showing the vicinity of the trailing edge of the left reel strip 106; FIG. 12B is a front view showing the vicinity of the trailing edge of the center reel strip 106; and FIG. 12C is a front view showing the vicinity of the trailing edge of the right reel strip 106. The marks 107 are printed on the overlap sections 106*a* of the respective reel strips 106 while being offset from each other in the spinning direction of the reels. More specifically, the mark 107 printed on the overlap section 106*a* of the center reel strip 106 (see FIG. 12B) is provided at a position which is offset from the that of the left reel toward the trailing edge by one-third of a symbol interval. Further, the mark 107 printed on the overlap section 106*a* of the right reel strip 106 (FIG. 12C) is provided at a position which is offset from the that of the center reel by one-third of a symbol interval toward the trailing edge. A common reel strip is used for the reel frameworks 101*a*, 101*b*, and 101*c*. Hence, the positions of the protrusions 105 on the reel strips remain unchanged. Therefore, the positions at which the left reel strip, the center reel strip, and the right reel strip are to be provided are shifted upstream from each other by one-third of a symbol with respect to the reel spinning direction. When a reel stop control operation analogous to that employed in the related-art slot machine is performed with such a configuration, the symbols on the left reel come to a standstill at their original positions on the display window 4, as shown in FIG. 13. In contrast, the symbols on the center reel and those on the right reel are shifted upstream from each other by only one-third of a symbol interval in the spinning direction of the reels.

The arrangements of the symbols provided on the respective reel strips of the slot machine according to the embodiment are the same as those shown in FIGS. 22 through 24. The data table used for controlling stoppage of the left reel is the same as that employed in the related art. The data table used for drawing "PLUM" on the left reel to the lower winning line is the same as that shown in FIG. 22. Here, the data tables to be used for controlling stoppage of the center and right reels differ from those employed in the related art.

FIG. 14 is an example data table to be used for controlling stoppage of the center reel in order to draw any one of the symbols having position numbers of 4, 9, 13, 16, and 20 to the lower line. As described in the field of "lower line movement timing," "RED 7" having a position number of 1 on the center reel is situated exactly at the lower line at a point in time when the timing count has assumed a value of 11.9 msec. The timing is shifted by only the time required for effecting movement corresponding to one-third of a symbol interval (35.714/3=11.9). As can be seen from a comparison between FIG. 14 and FIG. 23, which has been described previously, the timings are shifted from each other so as to lag by a period of 11.9 msec.

FIG. 15 is an example data table to be used for controlling stoppage of the right reel in order to draw any one of the symbols having position numbers of 4, 9, 13, 16, and 20 to the lower line. As described in the field of "lower line movement timing," "RED 7" having a position number of 1 on the center reel is situated exactly at the lower line at a point in time when the timing count has assumed a value of 23.8 msec. The timing is shifted by only the time required for effecting movement corresponding to two-thirds of a symbol interval (11.9×2=23.8). As can be seen from a comparison between FIG. 15 and FIG. 24, which has been described previously, the timings are shifted from each other so as to lag by only a period of 23.8 msec.

Figure 16:
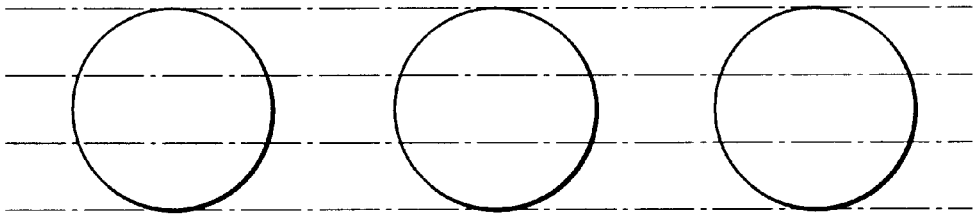
FIG. 16 is a schematic diagram showing a stopped state of symbols when reel stop control operation is performed through use of these data tables.
Figure 17A:
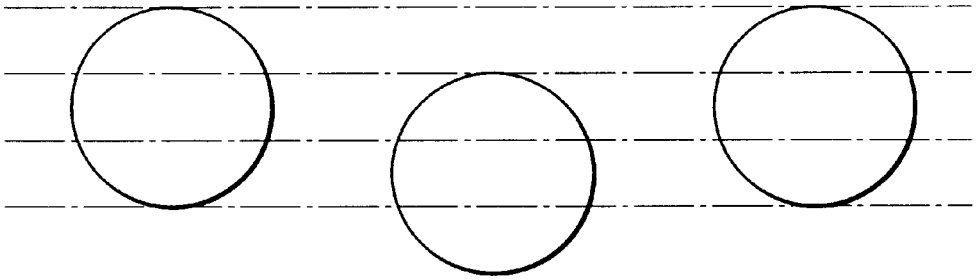
FIGS. 17A and 17B are schematic diagrams showing shift patterns of symbols arising when a left reel tape is erroneously applied on the center reel and on the right reel, respectively.
Figure 17B:
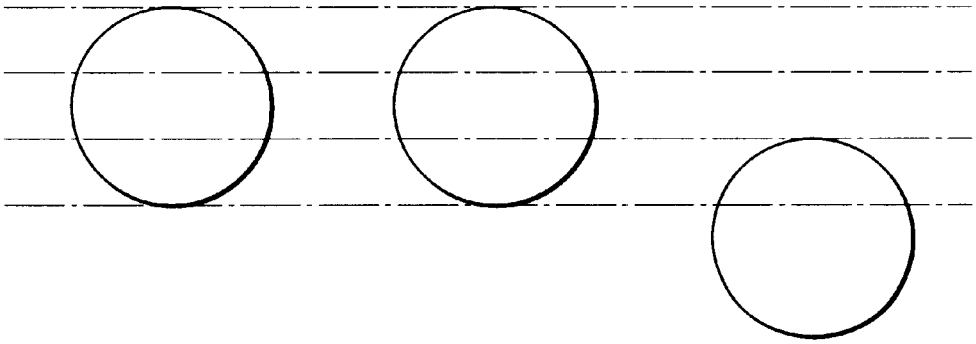
Figure 18A:
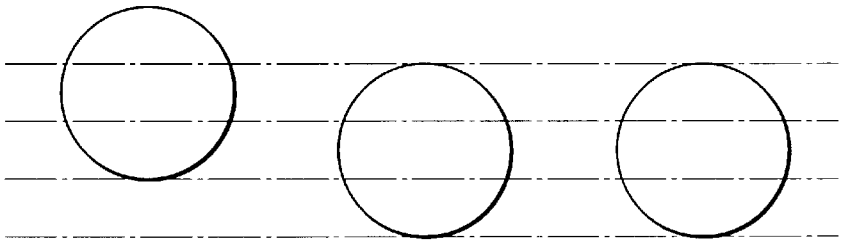
FIGS. 18A and 18B are schematic diagrams showing shift patterns of symbols arising when a center reel tape is erroneously applied on the left reel and on the right reel, respectively.
Figure 18B:
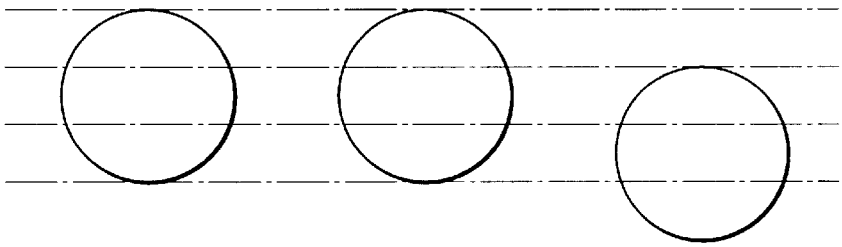
Figure 19A:
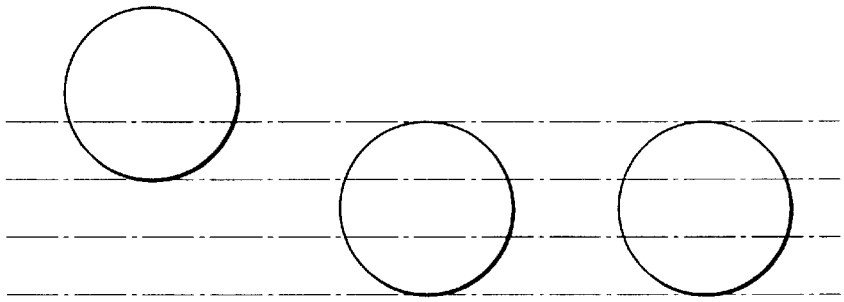
FIGS. 19A and 19B are schematic diagrams showing shift patterns of symbols a rising when a right reel tape is erroneously applied on the left reel and on the center reel, respectively.
Figure 19B:
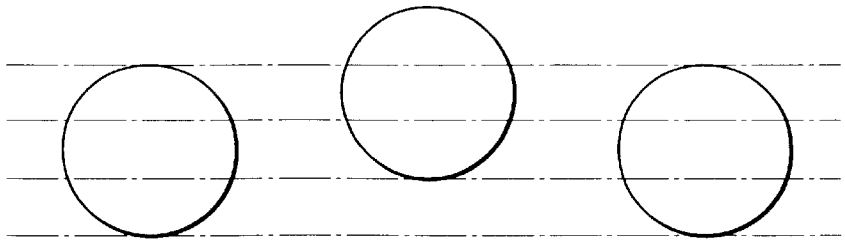
Figure 20:
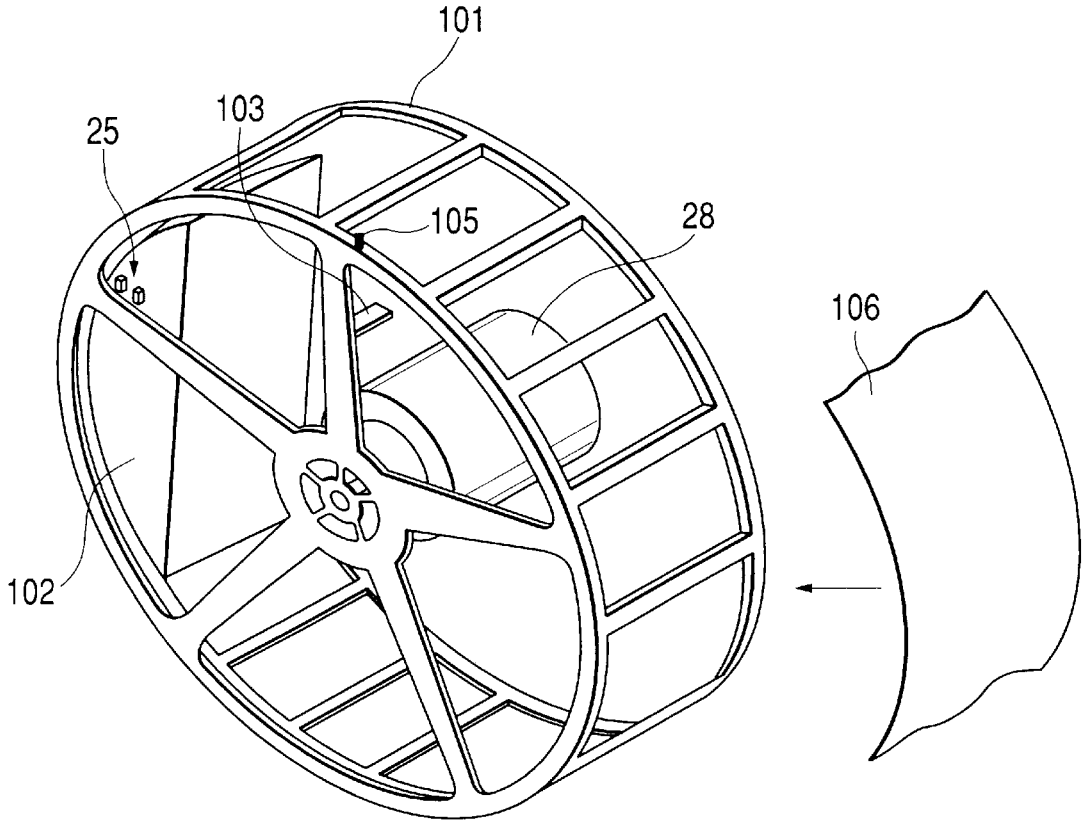
FIG. 20 is an exploded view showing a portion of a reel employed in the related-art slot machine.

When stoppage of the respective reels is controlled on the basis of the foregoing data tables, the symbols on the respective reels are neatly aligned in a horizontal direction, as shown in FIG. 16, within the display windows 4. If the left reel strip has erroneously been applied to the center reel, a symbol on the center reel is shifted downstream from the other symbols only by one-third of a symbol interval in the spinning direction, as shown in FIG. 17A. If the left reel strip has erroneously been applied to the right reel, a symbol on the right reel is shifted downstream from the other symbols only by two-thirds of a symbol interval in the spinning direction, as shown in FIG. 17B. Moreover, if the center reel strip has erroneously been applied to the left reel, a symbol on the left reel is shifted upstream from the other symbols only by one-third of a symbol interval in the spinning direction, as shown in FIG. 18A. Further, if the center reel strip has erroneously been applied to the right reel, a symbol on the right reel is shifted downstream from the other symbols only by one-third of a symbol interval in the spinning direction, as shown in FIG. 18B. If the right reel strip has erroneously been applied to the left reel, a symbol on the left reel is shifted upstream from the other symbols only by two-thirds of a symbol interval in the spinning direction, as shown in FIG. 19A. Further, if the right reel strip has erroneously been applied to the center reel, a symbol on the center reel is shifted upstream from the other symbols only by one-third of a symbol interval in the spinning direction, as shown in FIG. 19B. Similar shifts arise even if the reels may be placed at a wrong position on the slot machine after the reel strips have been applied on the reels.

As mentioned above, when a reel strip has been erroneously applied to an inappropriate reel or a reel has been erroneously attached to the slot machine, the position at which symbols on that reel are to stop is shifted in a spinning direction, thereby enabling a worker to readily realize the error. Thus, there can be inhibited occurrence of an incident in which a slot machine is shipped while a different reel strip has been applied onto a reel framework or a reel has been attached to a wrong position. Further, a pattern of shift changes according to the type of an erroneously-applied reel strip or the type of an erroneously-assembled reel. Hence, an erroneously-applied reel strip, a reel on which an inappropriate reel strip has been applied, a reel erroneously attached, and a location where an inappropriate reel has been attached through assembly can be readily identified.

A time (seconds) is used for FIGS. 22 through 24 and FIGS. 14 through 16, for convenience of comprehension. Needless to say, in reality, a time is controlled by means of changing the number of pulses to be used for driving the stepping motors.

The method of applying reel strips on respective reels while being shifted from each other may also include another method of forming the protrusions 105 for registration purpose on the reel frameworks so as to be shifted from each other, as well as a method of printing the marks 107 on the reel strips so as to be shifted from each other. However, under this method, even when a reel strip of different type has been applied to a reel framework dedicated to another type of reel strip, no change arises in the position where a symbol is to be stopped. Hence, a worker may realize erroneous attachment of a reel to a wrong position but may fail to realize erroneous attachment of a reel strip.

The above description has explained the embodiment in which symbols on respective reels are brought to a standstill while being aligned horizontally by means of shifting reel stop control timings of the respective reels from each other. Alternatively, the reel stop control timings may be made identical with those employed in the related art. Instead, the reel position sensors provided on the respective reels may be arranged so as to be shifted from each other in the spinning direction, thereby bringing symbols on the respective reels to a horizontally-aligned standstill. More specifically, the positions of the reel positions sensors 26, 27 shown in FIG. 8 may be shifted by only the amount corresponding to that by which the print positions of the marks 107 on the respective reel strips are shifted from each other, in the direction opposite to that in which the marks are shifted. As a result, spinning actions of the respective reels can be stopped such that symbols are aligned horizontally along a winning line by means of the same data table as that used in the related art (FIGS. 22 to 24) without use of special data tables used for shifting the reel stop timings, such as those shown in FIGS. 14 through 16. Although description has been given of the slot machine in which reels, which vertically spin, are disposed side by side in the horizontal direction, the reels may be disposed in the vertical direction or in a slanting direction. Further, although the slot machine having a roll unit has been described, needless to say, the invention can be applied to a game machine, such as a pachinko machine having a similar reel unit, as well as to the slot machine.

If the only necessity is to realize only erroneous attachment of a reel at a wrong position rather than both erroneous labeling of a reel strip and erroneous attachment of a reel at a wrong position, the reels may be arranged in the following manner. Specifically, the respective reels 100*a*, 100*b*, and 100*c* are provided with reel frameworks in which the sensing plates 103*a*, 103*b*, and 103*c* serving as sections to be detected are provided at different locations on the respective reel frameworks in the spinning direction of the reels. As a result, even if a reel has been erroneously attached, the reel is stopped at a timing different from the original timing, and a symbol on the reel is stopped at a position offset from the winning line, thereby enabling easy realization of erroneous attachment of the reel. Even in the case of such a construction, one of the following two methods may be adopted as a method for stopping reels such that symbols on the reels are aligned neatly along a winning line in the horizontal direction. Specifically, there is employed a method of using a data table which entails arrangement of reel position sensors disposed on respective reels so as to be shifted from each other in a spinning direction and which does not entail shifting of stop timings, and another method of using a data table which entails arrangement of the reel position sensors at the same positions and entails shifting of stop timings.

Although the explanation has been given of a slot machine which has reel units serving as main display units, the invention can also be applied to a display device which does not has any function of offering games, but only the function of successively displaying reel units.

According to the game machine of an invention, an error in the type of a reel strip applied on one of at least two rotary members can be readily identified. Hence, there is yielded a superior advantage of the ability to inhibit applying of a reel strip of inappropriate type on a rotary member.

According to the game machine of an invention, there is yielded a superior advantage of the ability to enable easy identification of an error in the type of a reel strip applied on one of at least two rotary members without involvement of consumption of labor, such as involvement of the trouble of causing stop control unit to function and causing the reels to stop at predetermined stop positions.

According to the game machine of an invention, errors in the types of reel strips applied on all rotary members can be readily identified. Hence, there is yielded a superior advantage of the ability to inhibit shipment of a game machine while symbols of inappropriate types are applied on rotary members, in a more reliable manner.

According to the game machine of an invention, even when a rotary member having a reel strip already applied thereon is attached to a wrong position on the game machine main unit, easy identification of the error is enabled. There is yielded an advantage of the ability to inhibit shipment of a game machine while a rotary member is attached to a wrong position.

According to the game machine of an invention, symbols on the respective rotary members can be horizontally aligned side by side at predetermined positions on respective main display units. There is yielded a superior advantage of the ability to prevent deterioration of ease of recognition of a combination of symbols, which would otherwise be attributable to misalignment of symbols in the horizontal direction. Further, there is also yielded an advantage of the ability to identify an error in the type of a reel strip and an error in the location where a rotary member is attached more easily.

According to the game machine of an invention, errors in the types of reel strips applied on all rotary members can be readily identified. Hence, there is yielded an advantage of the ability to prevent shipment of a game machine while symbols of inappropriate types are applied on rotary members. Further, there is yielded an advantage of the ability to identify an error in the type of a reel strip applied without shifting the timings at which rotary members are to be stopped.

According to the game machine of an invention, a difference in the types of reel strips applied on at least two rotary members can be identified readily. Hence, there is yielded a superior advantage of the ability to inhibit shipment of a slot machine while symbols of inappropriate types are applied on a rotary member.

What is claimed is:

1. A game machine comprising:

a main display in which a plurality of reels, rotatable in a spinning direction, are disposed side by side, each of the plurality of reels including, a reference mark representing a reference position at which a reel strip is to be applied, the reel strip on which a plurality of symbols are applied and which is provided on an annular peripheral face thereof, and includes a positioning mark provided on the reel strip for effecting alignment between the positioning mark and the reference mark, a rotational position sensor for sensing a predetermined rotational position of the reel, and a drive unit for operatively rotating the reel, wherein at least two of the reel strip differ in terms of relative position in the spinning direction of the reel between the symbols on the reel strip and the corresponding positioning mark, and wherein when the respective reel come to a standstill at the predetermined rotation positions, positions of respective symbols defined between the reel corresponding to the at least two reel strips are shifted from each other in the spinning direction.

2. The game machine according to claim 1, wherein the respective rotational position sensor senses sections to be detected provided on corresponding reels, thereby senses the predetermined rotational positions, and the reels corresponding to at least two of the reel strips differ in terms of an angle formed between the symbols on the reel strip and the section to be detected, so that positions of respective symbols on rotation paths are shifted from each other in the spinning direction.

3. The game machine according to claim 1, wherein all the reel strips differ in terms of the relative position in the spinning direction, and when the respective reels come to a standstill at the predetermined rotation positions, positions of respective symbols on rotation paths are shifted from each other in the spinning direction.

4. The game machine according to claim 3, wherein all the rotational position sensor sense the same rotational positions of the reels; and, when all the rotary members come to a standstill at the rotational positions, the reference marks are stopped at identical locations in a spinning direction.

5. The game machine according to claim 3 further comprising a stop control unit for controlling stoppage of the respective reels at detection timing defined by the corresponding rotational position sensor, wherein the stop control unit causes mutual shifting of spin stop timings of the reels determined by the detection timings of the rotation position sensor, so as to display the symbols of the respective reels at the predetermined positions on the main display unit while being aligned with each other.

6. A game machine including:

a main display in which a plurality of reels, rotatable in a spinning direction, are disposed side by side, each of the plurality of reels including, a reference mark representing a reference position at which a reel strip is to be applied, wherein the reel strips differ in terms of a relative position in the spinning direction between symbols on the reel strip and the positioning mark, the reel strip on which a plurality of symbols are applied and which is provided on an annular peripheral face thereof, and includes a positioning mark provided on the reel strip for effecting alignment between the positioning mark and the reference mark, a rotational position sensor for sensing a predetermined rotational position of the reel, and a drive unit for operatively rotating the reel, wherein the reference marks respectively provided on the reels are provided at the same locations on the reels in the spinning direction, wherein the respective rotational position sensors sense rotational positions of the rotary members, which differ from each other, such that the respective rotational position sensor senses the predetermined locations in the corresponding reels at a timing at which the respective symbols on rotational paths assume the same positions on the reels.

7. A display apparatus comprising:

a main display in which a plurality of reels, rotatable in a spinning direction, are disposed side by side, each of the plurality of reels including, a reference mark representing a reference position at which a reel strip is to be applied, the reel strip on which a plurality of symbols are applied and which is provided on an annular peripheral face thereof, and includes a positioning mark provided on the reel strip for effecting alignment between the positioning mark and the reference mark, a rotational position sensor for sensing a predetermined rotational position of the reel, and a drive unit for operatively rotating the reel, wherein at least two of the reel strips differ in terms of a relative position in the spinning direction between symbols on each of the reel strip and the positioning mark, and wherein when the respective reels come to a standstill at the predetermined rotation positions, positions of respective symbols on rotation paths corresponding to at least two reel strips are shifted from each other in the spinning direction.

* * * * *